US011713651B2

(12) United States Patent
Al-Huwaider et al.

(10) Patent No.: US 11,713,651 B2
(45) Date of Patent: Aug. 1, 2023

(54) HEATING A FORMATION OF THE EARTH WHILE DRILLING A WELLBORE

(71) Applicant: Saudi Arabian Oil Company, Dhahran (SA)

(72) Inventors: Mustafa A. Al-Huwaider, Dhahran (SA); Shouxiang Mark Ma, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 7 days.

(21) Appl. No.: 17/317,556

(22) Filed: May 11, 2021

(65) Prior Publication Data

US 2022/0364439 A1 Nov. 17, 2022

(51) Int. Cl.
*E21B 36/00* (2006.01)
*E21B 47/07* (2012.01)
(Continued)

(52) U.S. Cl.
CPC ..... *E21B 36/00* (2013.01); *E21B 7/04* (2013.01); *E21B 36/04* (2013.01); *E21B 44/00* (2013.01); *E21B 44/02* (2013.01); *E21B 47/07* (2020.05)

(58) Field of Classification Search
CPC ... E21B 47/07; E21B 7/04; E21B 7/06; E21B 36/04; E21B 44/00
See application file for complete search history.

(56) References Cited

U.S. PATENT DOCUMENTS 3,170,519 A * 2/1965 Haagensen ..... H05B 6/80 219/679
3,807,227 A 4/1974 Smith, Jr.
(Continued)

FOREIGN PATENT DOCUMENTS

CN 102619484 8/2012
CN 107829726 3/2018
(Continued)

OTHER PUBLICATIONS

Ellison, Candice, James Hoffman, and Dushyant Shekhawat. "Comparison of microwave and conventional heating for CO2 desorption from zeolite 13X." International Journal of Greenhouse Gas Control 107 (2021): 103311. https://doi.org/10.1016/jJggc.2021.103311 (Year: 2021).*
(Continued)

*Primary Examiner* — Theodore N Yao
(74) *Attorney, Agent, or Firm* — Fish & Richardson P.C.

(57) ABSTRACT

A method and an assembly for heating and evaluating a formation of the Earth while drilling a wellbore filled with drilling mud are described. A first drilling mud temperature at a depth in the wellbore is received from a first sensor by a controller. The formation proximal to the depth is heated by a heat source mounted to the assembly to a temperature greater than a formation temperature as the drilling assembly drills the wellbore. A second drilling mud temperature is received from a second sensor by the controller. The heat source is positioned in between the first sensor and the second sensor. A difference between the first drilling mud temperature and the second drilling mud temperature is compared to a threshold drilling mud temperature difference value by the controller. Based on a result of the comparison, the drilling assembly is controlled and directed in the formation.

16 Claims, 18 Drawing Sheets

(51) Int. Cl.

| | |
|---|---|
| ***E21B 7/04*** | (2006.01) |
| ***E21B 36/04*** | (2006.01) |
| ***E21B 44/00*** | (2006.01) |
| ***E21B 44/02*** | (2006.01) |

(56) References Cited

U.S. PATENT DOCUMENTS

| | | | | |
|---|---|---|---|---|
| 3,903,974 | A | 9/1975 | Cullen | |
| 4,343,181 | A * | 8/1982 | Poppendiek | E21B 47/07 73/152.13 |
| 4,754,839 | A | 7/1988 | Rathman | |
| 4,899,112 | A | 2/1990 | Clark et al. | |
| 4,929,113 | A | 5/1990 | Sheau | |
| 4,974,691 | A * | 12/1990 | Leaney | E21B 17/1064 175/325.3 |
| 5,497,321 | A | 3/1996 | Ramakrishnan et al. | |
| 5,531,112 | A | 7/1996 | Young et al. | |
| 6,028,307 | A | 2/2000 | Young et al. | |
| 6,061,634 | A | 5/2000 | Belani et al. | |
| 6,176,323 | B1 * | 1/2001 | Weirich | E21B 49/005 175/40 |
| 6,188,222 | B1 | 2/2001 | Seydoux et al. | |
| 6,301,959 | B1 | 10/2001 | Hrametz et al. | |
| 6,655,462 | B1 | 12/2003 | Carmichael et al. | |
| 6,745,835 | B2 | 6/2004 | Fields | |
| 7,086,484 | B2 | 8/2006 | Smith, Jr. | |
| 7,334,637 | B2 | 2/2008 | Smith, Jr. | |
| 7,607,478 | B2 | 10/2009 | Martinez et al. | |
| 7,644,610 | B2 | 1/2010 | Meister | |
| 7,703,317 | B2 | 4/2010 | Goodwin et al. | |
| 7,753,125 | B1 | 7/2010 | Penisson | |
| 7,789,170 | B2 | 9/2010 | Church | |
| 8,109,140 | B2 | 2/2012 | Tustin et al. | |
| 8,265,874 | B2 | 9/2012 | Ma et al. | |
| 8,408,307 | B2 | 4/2013 | Telfer | |
| 8,496,054 | B2 | 7/2013 | Zazovsky et al. | |
| 8,550,184 | B2 | 10/2013 | Buchanan et al. | |
| 8,593,140 | B2 | 11/2013 | Saldungaray et al. | |
| 8,904,857 | B2 | 12/2014 | Tustin et al. | |
| 8,955,584 | B2 | 2/2015 | Telfer | |
| 8,978,481 | B2 | 3/2015 | Powell et al. | |
| 9,109,417 | B2 | 8/2015 | Leiper et al. | |
| 9,303,509 | B2 | 4/2016 | Milkovisch et al. | |
| 9,383,476 | B2 | 7/2016 | Trehan et al. | |
| 9,442,211 | B2 | 9/2016 | Seydoux et al. | |
| 9,752,433 | B2 | 9/2017 | Proett et al. | |
| 10,208,582 | B2 | 2/2019 | Ma et al. | |
| 10,247,849 | B2 | 4/2019 | Pfutzner et al. | |
| 10,316,648 | B2 | 6/2019 | Swett | |
| 10,526,871 | B2 | 1/2020 | Tzallas et al. | |
| 10,545,129 | B2 | 1/2020 | Nguyen et al. | |
| 10,626,721 | B2 | 4/2020 | Gisolf et al. | |
| 2004/0244970 | A1 * | 12/2004 | Smith, Jr. | E21B 43/11 175/50 |
| 2007/0261855 | A1 | 11/2007 | Brunet et al. | |
| 2008/0066536 | A1 | 3/2008 | Goodwin et al. | |
| 2008/0210420 | A1 | 9/2008 | Ramakrishnan et al. | |
| 2009/0008079 | A1 | 1/2009 | Zazovsky et al. | |
| 2009/0159278 | A1 | 6/2009 | Corre et al. | |
| 2010/0096137 | A1 | 4/2010 | Nguyen et al. | |
| 2010/0126717 | A1 | 5/2010 | Kuchuk et al. | |
| 2011/0272150 | A1 | 11/2011 | Ives et al. | |
| 2012/0312530 | A1 | 12/2012 | Pope et al. | |
| 2013/0020128 | A1 | 1/2013 | Calleri | |
| 2013/0037270 | A1 | 2/2013 | DiFoggio | |
| 2013/0081879 | A1 | 4/2013 | Ward et al. | |
| 2013/0175036 | A1 | 7/2013 | Hausot | |
| 2015/0322720 | A1 | 11/2015 | Pelletier et al. | |
| 2016/0053596 | A1 * | 2/2016 | Rey | E21B 43/2401 166/302 |
| 2016/0326866 | A1 | 11/2016 | Swett | |
| 2017/0002646 | A1 | 1/2017 | Bonavides et al. | |
| 2017/0122092 | A1 * | 5/2017 | Harmer | E21B 44/06 |
| 2019/0129056 | A1 | 5/2019 | Rasmus et al. | |
| 2019/0277806 | A1 | 9/2019 | Huang | |
| 2020/0003599 | A1 | 1/2020 | Theuveny et al. | |
| 2021/0108505 | A1 | 4/2021 | Challener et al. | |

FOREIGN PATENT DOCUMENTS

| | | |
|---|---|---|
| EP | 0514657 | 4/1992 |
| WO | WO 2014012781 | 1/2014 |

OTHER PUBLICATIONS

Ellison, C., McKeown., Trabelsi, Marculescu, and Boldor, 2018. Dielectric characterization of bentonite clay at various moisture contents and with mixtures of biomass in the microwave spectrum. Journal of Microwave Power and Electromagnetic Energy, 52(1), pp. 3-15, DOI: 10.1080/08327823.2017.1421407 (Year: 2018).*

Ellison, C., Abdelsayed, V., Smith, M. and Shekhawat, D., 2022. Comparative evaluation of microwave and conventional gasification of different coal types: Experimental reaction studies. Fuel, 321, p. 124055. https://doi.org/10.1016/j.fuel.2022.124055 (Year: 2022).*

PCT International Search Report and Written Opinion in International Appln. No. PCT/US2022/072254, dated Jul. 13, 2022, 15 pages.

U.S. Appl. No. 16/863,740, filed Apr. 30, 2020, Al-Huwaider.

"Multiple Array Production Suite (MAPS)," Proactive Diagnostic Services, Well Integrity Diagnostic Specialists, 2017, Brochure, 2 pages.

Abernethy, "Production increase of heavy oils by electromagnetic heating," Journal of Canadian Petroleum Technology, Jul.-Sep. 1976, 8 pages.

Almansour and Al-Bassaz, "Physical and Chemical characterization and evaluation of organic matter from tar-mat samples: Case Study of Kuwaiti Carbonate Reservoir," Journal of Chemical Technology App 1:1, Sep. 2017, 12 pages.

Alomair et al., "Viscosity Prediction of Kuwaiti Heavy Crudes at Elevated Temperatures," SPE 150503, Society of Petroleum Engineers (SPE), presented at the SPE Heavy Oil Conference and Exhibition, Kuwait, Dec. 12-14, 2011, 18 pages.

bakerhughes.com [online] "VACS G2 system," Baker Hughes, available on or before Oct. 5, 2020, retrieved on Jan. 7, 2021, retrieved from URL <https://www.bakerhughes.com/wellbore-cleanup/vacs-g2-system>, 5 pages.

bakerhughes.com [online] "Vectored annular cleaning system (VACS) technology," available on or before Oct. 5, 2020, retrieved on Jan. 7, 2021, retrieved from URL https://www.bakerhughes.com/wellbore-cleanup/vectored-annular-cleaning-system-vacs-technology, 4 pages.

Bauldauff et al., "Profiling and quantifying complex multiphase flow," Oilfield Review, Autumn 2004, 10 pages.

Bermudez et al., "Assisted Extra Heavy Oil Sampling by Electromagnetic Heating," SPE 171073-MS, Society of Petroleum Engineers (SPE), presented at the SPE Heavy and Extra Heavy Oil Conference—Latin American, Colombia, Sep. 24-26, 2014, 13 pages.

Bristow et al., "Measurement of Soil Thermal Properties with a Dual-Probe Heat-Pulse Technique," Soil Sci. Soc. Am. J. 58:1288-1294, Sep. 1994, 7 pages.

glossary.oilfield.slb.com [online], "Distributed temperature log," retrieved from URL <https://www.glossary.oilfield.slb.com/en/Terms/d/distributed_temperature_log.aspx>, retrieved on Feb. 12, 2020, available on or before 2020, 1 page.

halliburton.com, [online], "CoreVault System," available on or before 2020, retrieved on Nov. 9, 2020, retrieved from URL <https://www.halliburton.com/en-US/ps/wireline-perforating/wireline-and-perforating/open-hole-logging/sidewall-coring/corevault.html>, 2 pages.

horizontalwireline.com [online], "Multi-arm Caliper MAC 40," retrieved from URL <https://horizontalwireline.com/wp-content/uploads/2014/09/AHWS-Multi-Arm_Caliper.pdf>, retrieved on Feb. 12, 2020, available on or before 2014, 2 pages.

Kelder et al., "Expanding advanced production logging operations to short radius horizontal wells," SPE 93526, Society of Petroleum

(56) References Cited

OTHER PUBLICATIONS

Engineers (SPE), presented at the 14th SPE Middle East Oil & Gas Show and Conference, Bahrain International Exhibition Centre, Bahrain, Mar. 12-15, 2005, 7 pages.
Liu, "Acoustic Properties of Reservoir Fluids," A Dissertation Submitted to the Department of Geophysics and Committee on Graduate Studies of Stanford University in Partial Fulfillment of the Requirements for the Degree of Doctor of Philosophy, Jun. 1998, 111 pages.
Ma et al., "Cased-hole reservoir saturation monitoring in mixed-salinity environments—A new integrated approach," SPE 92426, Society of Petroleum Engineers (SPE), presented at the 14th SPE Middle East Oil & Gas Show and Conference, Bahrain, Mar. 12-15, 2005, 10 pages.
Ma et al., "Dynamic petrophysics—applications of time-lapse reservoir monitoring in Saudi Arabia," SPE 95882, Society of Petroleum Engineers (SPE), presented at the 2005 SPE Annual Technical Conference and Exhibition, Dallas, Texas, Oct. 9-12, 2005, 8 pages.
Ma et al., "Resolving the mixed salinity challenges with a methodology developed from pulsed neutron capture gamma ray spectral measurements," SPE 170608, Society of Petroleum Engineers (SPE), presented at the SPE Annual Technical Conference and Exhibition, Amsterdam, The Netherlands, Oct. 27-29, 2014, 12 pages.
McCoy et al., "Analyzing Well Performance VI," Southwestern Petroleum Short Course Association, Lubbock, 1973, 9 pages.
metergroup.com [online], "Thermal Properties: Why the TEMPOS method outperforms other techniques," retrieved from URL <https://www.metergroup.com/environment/articles/thermal-properties-transient-methodoutperforms-techniques/>, retrieved on Feb. 12, 2020, available on or before 2020, 6 pages.
Mohamed et al., "Leak Detection by Temperature and Noise Logging," Society of Petroleum Engineers, Abu Dhabi International Petroleum Conference and Exhibition, Nov. 11-14, 2012, Abu Dhabi, UAE, abstract retrieved from URL <https://archive.is/20130628032024/http://www.onepetro.org/mslib/servlet/onepetropreview#selection-191.0-191.96>, retrieved on Feb. 12, 2020, 2 pages, Abstract Only.
Moses, "Geothermal Gradients," Drilling & Production Practice, Core Lab. Inc., Dallas, Texas, 1961, 7 pages.
oilproduction.net [online], "Acoustic Velocity for Natural Gas," retrieved on Jan. 7, 2021, URL <http://oilproduction.net/files/Acoustic%20Velocity%20for%20Natural%20Gas.pdf>, 6 pages.
slb.com [online] "Well Scavenger," Schlumberger, available on or before Aug. 3, 2020, via Internet Archive: Wayback Machine URL <http://web.archive.org/web/20200803130523/https://www.slb.com/completions/fluids-and-tools/wellbore-cleaning-tools/debris-recovery-tools/well-scavenger-vacuum-debris-removal-tool>, retrieved on Jan. 12, 2021, URL <https://www.slb.com/completions/fluids-and-tools/wellbore-cleaning-tools/debris-recovery-tools/well-scavenger-vacuum-debris-removal-tool>, 5 pages.
slb.com [online], "PS Platform, Production services platform," retrieved from URL <https://www.slb.eom/-/media/files/production/product-sheet/ps_platform_ps.ashx>, retrieved on Feb. 12, 2020, available on or before 2014, 3 pages.
Thomas et al., "Determination of Acoustic Velocities for Natural Gas," SPE 2579, Society of Petroleum Engineers (SPE), Journal of Petroleum Technology, Jul. 1970, 22(7):889-895.
Wang et al., "Acoustic Velocities in Petroleum Oils," SPE 18163 MS/ SPE 18163 PA, Society of Petroleum Engineers (SPE), presented at the SPE Annual Technical Conference and Exhibition, Oct. 2-5, 1988, 15 pages.
wildcatoiltools.com [online] "HydroVortex," Wildcat Oil Tools, available on or before Oct. 5, 2020, retrieved on Jan. 12, 2021, retrieved from URL <https://www.wildcatoiltools.com/hydrovortex>, 5 pages.
Wilhelms and Larter, "Origin of tar mats in petroleum reservoirs Part II: Formation mechanisms for tar mats," Marine Petroleum Geology 11:4, Aug. 1994, 15 pages.

* cited by examiner

HEATING A FORMATION OF THE EARTH WHILE DRILLING A WELLBORE

TECHNICAL FIELD

This disclosure relates to operations performed while drilling a wellbore in a formation of the Earth.

BACKGROUND

Hydrocarbons are trapped in formations of the Earth. Wellbores are drilled by a drilling assembly through those formations. The wellbores conduct the hydrocarbons to the surface. Sometimes, the drilling assembly is controlled to maintain the drilling assembly in the hydrocarbon containing formation or, if the drilling assembly has strayed from the hydrocarbon containing formation, to return the drilling assembly to the hydrocarbon containing formation.

SUMMARY

This disclosure describes technologies related to heating and evaluating a formation of the Earth while drilling a wellbore in the formation. Implementations of the present disclosure include a method for heating and evaluating a formation of the Earth while drilling a wellbore in the formation. The method includes, while drilling the wellbore filled with drilling mud in a target zone of the formation of the Earth with a drilling assembly, receiving a first signal representing a first temperature of the drilling mud at a drilling end of the drilling assembly from a first sensor by a controller. The first temperature of the drilling mud is sensed at a depth in the wellbore. Receiving the first signal representing the first temperature of the drilling mud at the depth can include sensing, by the first sensor, the first temperature of a portion of a drilling mud in the wellbore proximal to the formation at the depth in the wellbore.

The method includes, after receiving the first signal, a heat source mounted to the drilling assembly heating a portion of the formation proximal to the depth to a temperature greater than a formation temperature as the drilling assembly drills through the formation of the Earth. In some implementations, the heat source is multiple magnetrons. Where the heat source is multiple magnetrons, heating the formation includes energizing the magnetrons and transmitting microwaves from each of the magnetrons to the formation. In some implementations, heating the formation further includes transmitting the microwaves from each of the magnetrons in an axis parallel to a longitudinal axis of the drilling assembly.

In some implementations, the drilling assembly includes a sleeve. The sleeve is mechanically coupled to a downhole conveyor by a bearing assembly. The sleeve is rotatably isolated from a rotation of the drilling assembly. The magnetrons are positioned on the sleeve. In such implementations, transmitting the microwaves from each of the magnetrons in an axis parallel to a longitudinal axis of the drilling assembly includes rotating the drilling assembly and maintaining, by the bearing assembly, the axis of the plurality of magnetrons parallel to the longitudinal axis of the drilling assembly.

In some implementations, the sleeve is electrically coupled to a power source by an electrical slip ring. In such cases, transmitting the microwaves from each of the magnetrons in an axis parallel to a longitudinal axis of the drilling assembly includes flowing electricity from the power source, receiving electricity at the electrical slip ring, transferring the electricity through the electrical slip ring, and flowing electricity to the magnetrons.

The method includes, simultaneously while heating the portion of the formation proximal to the depth while the drilling assembly drills through the formation of the Earth and the drilling mud receiving heat back from the portion of the formation by a flow of the drilling mud, evaluating the heated formation. The heated formation is evaluated by receiving a second signal representing a second temperature of the drilling mud from a second sensor by the controller. The second sensor is farther from the drilling end of the drilling assembly than the first sensor. The heat source is positioned in the drilling assembly between the first sensor and the second sensor. In some implementations, receiving the second signal representing the second temperature of the drilling mud by the controller and from the second sensor includes sensing, by the second sensor, the second temperature of the portion of the drilling mud in the wellbore proximal to the formation.

The method includes comparing a difference between the value of the first temperature of the drilling mud and the value of the second temperature of the drilling mud to a threshold drilling mud temperature difference value with the controller. Comparing, by the controller, the difference between the value of the first temperature of the drilling mud and the value of the second temperature of the drilling mud to the threshold drilling mud temperature difference value can include determining when the difference between the value of the first temperature of the drilling mud and the value of the second temperature of the drilling mud is less than the threshold drilling mud temperature difference value, indicating that the drilling assembly is in an oil-bearing portion of the formation. The target zone is the oil-bearing portion of the formation.

In some implementations, comparing the difference between the value of the first temperature of the drilling mud and the value of the second temperature of the drilling mud to the threshold drilling mud temperature difference value by the controller can include determining when the difference between the value of the first temperature of the drilling mud and the value of the second temperature of the drilling mud is greater than the threshold drilling mud temperature difference value, indicating that the drilling assembly is in a water-bearing portion of the formation. The target zone is the oil-bearing portion of the formation.

The method includes, based on a result of the comparison, controlling the drilling assembly in the formation by the controller. In some implementations, controlling the drilling assembly in the formation by the controller includes, responsive to determining when the difference between the value of the first temperature of the drilling mud and the value of the second temperature of the drilling mud is less than the threshold drilling mud temperature difference value, maintaining the drilling assembly in the target zone.

In some implementations, controlling the drilling assembly in the formation with the controller includes, responsive to determining when the difference between the value of the first temperature of the drilling mud and the value of the second temperature of the drilling mud is greater than the threshold drilling mud temperature difference value, steering the drilling assembly from the water-bearing portion of the formation to oil-bearing portion of the formation. Steering the drilling assembly can include adjusting a weight on bit, a revolution per minute, a tool face orientation, a drilling direction, a drilling azimuth, or a drilling mud flow rate.

Further implementations of the present disclosure include an assembly for heating and evaluating a formation of the Earth while drilling a wellbore in the formation. The assembly includes a sleeve. The sleeve couples to a drilling assembly and disposed in a wellbore. The wellbore is filled with a drilling mud.

The assembly includes a heat source positioned in the sleeve. The heat source heats a portion of a formation of the Earth. In some implementations, the heat source includes multiple magnetrons. A portion of the magnetrons can be arranged linearly relative to a longitudinal axis of the sleeve.

The assembly includes a first sensor positioned at a first end of the sleeve. The first sensor senses a first condition of the drilling mud at a depth and transmit a signal representing a value of the first condition of the drilling mud at the depth before the heat source heats the portion of the formation of the Earth. The first sensor can be a temperature sensor.

The assembly includes a second sensor positioned at a second end of the sleeve. The second sensor senses a second condition of the drilling mud responsive to the drilling mud receiving heat back from the portion of the formation by a flow of the drilling mud after the heat source heats the portion of the formation of the Earth and transmit a signal representing a value of the second condition of the drilling mud. The second sensor can be a temperature sensor.

The assembly includes a controller. The controller receives the signal representing the value of the first condition, receives the signal representing the value of the second condition, and compares a difference between the value of the first condition and the value of the second condition of the formation to a threshold difference value. In some implementations, the threshold difference value is a threshold drilling mud temperature difference value. Based on a result of the comparison, the controller generates a command signal to control the drilling assembly.

In some implementations, the controller compares the difference between the value of the first temperature of the drilling mud and the value of the second temperature of the drilling mud to the threshold drilling mud temperature difference value. Responsive to the comparison, the controller can determine when the difference between the value of the first temperature of the drilling mud and the value of the second temperature of the drilling mud is less than the threshold drilling mud temperature difference value, indicating the drilling assembly is in an oil-bearing portion of the formation and a target zone is the oil-bearing portion of the formation. Responsive to determining when the difference between the value of the first temperature of the drilling mud and the value of the second temperature of the drilling mud is less than the threshold drilling mud temperature difference value, the controller can maintain the drilling assembly in the target zone.

In some implementations, the controller compares the difference between the value of the first temperature of the drilling mud and the value of the second temperature of the drilling mud to the threshold drilling mud temperature difference value by determining when the difference between the value of the first temperature of the drilling mud and the value of the second temperature of the drilling mud is greater than the threshold drilling mud temperature difference value, indicating the drilling assembly is in a water-bearing portion of the formation and the target zone is the oil-bearing portion of the formation. Responsive to determining when the difference between the value of the first temperature of the drilling mud and the value of the second temperature of the drilling mud is greater than the threshold drilling mud temperature difference value, the controller can steer the drilling assembly from the water-bearing portion of the formation to the oil-bearing portion of the formation.

In some implementations, the assembly includes a first connection mechanically coupled to the sleeve. The first connection mechanically couples to a downhole conveyor. In some implementations, the assembly includes a second connection mechanically coupled to the sleeve. The second connection mechanically couples to a downhole tool.

In some implementations, the assembly includes a bearing assembly positioned within the sleeve. The bearing assembly rotatably isolates the sleeve from a rotation of a downhole conveyor.

In some implementations, the assembly includes multiple bars mechanically coupled to an outside surface of the sleeve. The bars slideably engage an inner surface of the wellbore.

In some implementations, the assembly includes an electrical slip ring positioned within the sleeve. The electrical slip ring transfers electricity from a power source to the heat source.

Further implementations of the present disclosure include another method for heating and evaluating a formation of the Earth while drilling a wellbore in the formation. The method includes heating a portion of the formation with a heat source to a temperature greater than a formation temperature while drilling a wellbore in a formation of the Earth with a drilling assembly including the heat source. The wellbore is filled with a drilling mud. Heating the portion of the formation to a temperature greater than the formation temperature can include transmitting microwaves into the portion of the formation by multiple magnetrons.

The method includes evaluating the heated formation by measuring a change in a temperature of the drilling mud responsive to the drilling mud receiving heat back from the portion of the formation by a flow of the drilling mud with a controller of the drilling assembly. The method includes, based on a result of measuring the change in the temperature of the drilling mud, adjusting a drilling parameter of the drilling assembly.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
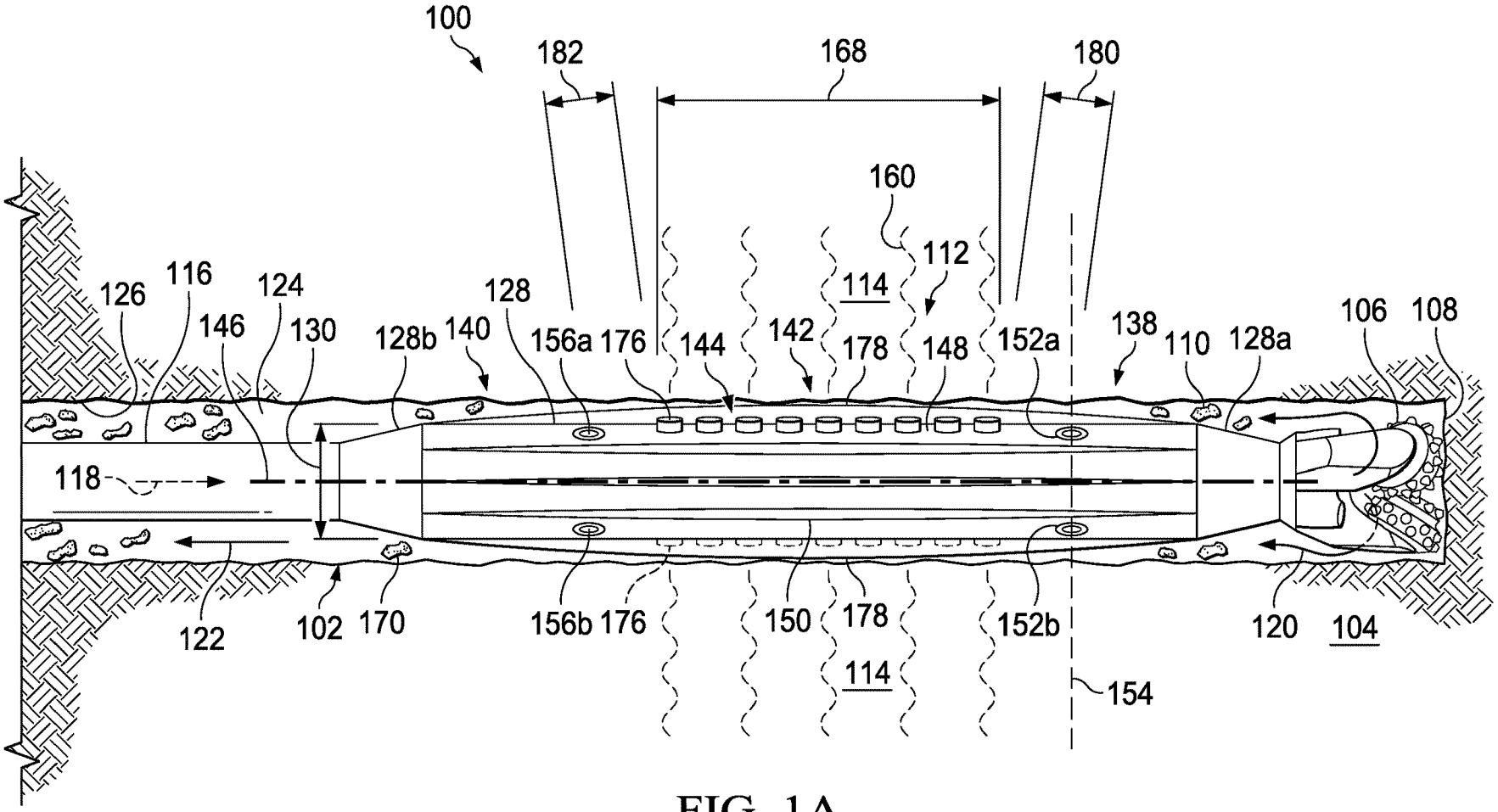
FIG. 1A is a schematic view of a drilling assembly including a heating assembly disposed in a wellbore.

The present disclosure describes a method and an assembly for heating and evaluating a formation of the Earth while drilling a wellbore in the formation. Formations of the Earth are filled with both liquid and gaseous phases of various fluids and chemicals including water, oils, and hydrocarbon gases. Wellbores are drilled in the formations of the Earth to form an oil and gas production well or a water injection well. The wellbore conducts the water, oils, and hydrocarbon gases to a surface of the Earth. The wellbore contains a drilling mud. The wellbore is drilled with a drilling assembly. The drilling assembly includes a heat source. While the drilling assembly is drilling the wellbore, the heat source heats a portion of the formation surrounding the heat source to a temperature above the formation temperature. The heat is transferred back to the drilling mud. The drilling mud in the wellbore acts as a heat exchanger. The drilling mud differential temperature change across the formation is measured. Based on a result of measuring the change in the drilling mud differential temperature which corresponds to the formation temperature change, formation characteristics are evaluated and a drilling parameter of the drilling assembly is adjusted.

The heater assembly for heating and evaluating a formation while drilling the wellbore has a sleeve coupled to the drilling assembly. The heat source is positioned in the sleeve. The heat source transmits heat into the formation of the Earth. A first sensor and a second sensor are coupled to the sleeve. The first sensor is positioned at a first end of the sleeve. The first sensor senses a first temperature of the drilling mud which corresponds to the first temperature of the formation before the heat source at a depth, then transmits a signal representing a value of the first temperature to a controller positioned in the sleeve. The second sensor is positioned at a second end of the sleeve. The second sensor senses a second temperature of the drilling mud which corresponds to the second temperature of the formation after the heat source heats the formation and the drilling mud receives heat back from the portion of the formation by a flow of the drilling mud. The second sensor transmits a signal representing a value of the second temperature to the controller.

The controller receives the two signals representing the values of the first and second temperatures of the drilling mud. Then, the controller compares a difference between the values of the temperatures of the drilling mud to a drilling mud threshold temperature difference value. Based on a result of the comparison, the controller generates a command signal to control the drilling assembly. In some cases, the command signal is transmitted to the drilling assembly after verification by the operator. The drilling assembly is controlled for optimal well placement, that is, to place the wellbore in the oil-bearing portion of the formation.

Implementations of the present disclosure realize one or more of the following advantages. Changes in formation characteristics can be detected sooner. Fresh water and mixed salinity water in a formation can reduce downhole electro-magnetic logging tool sensitivity to changes in formation characteristics. Measuring a formation temperature change through the drilling mud responsive to a heat input is insensitive to water salinity, and therefore temperature changes can be detected with higher accuracy than an electro-magnetic logging tool can detect the change in formation characteristics in situations where formation water is either fresh water or mixed salinity water. As a result, changes in formation characteristics can be detected better and with improved accuracy by using drilling mud related formation temperature change measurements. Wellbore placement can be improved. For example, when drilling in a target formation zone and no change in formation characteristics has been detected through the drilling mud, the path of the drilling assembly can be maintained in the target zone. For example, when drilling in a target zone and a change in formation characteristics has been detected indicating that the drilling assembly is in another zone of the formation other than the target zone, the drilling assembly can be steered back to the target zone from the other zone outside the target zone sooner. An increased quantity of oil and hydrocarbon gas can be produced from an oil-bearing zone within the formation. For example, when the wellbore is adjusted responsive to formation characteristic changes detected by temperature changes responsive to heating the formation, the wellbore placement can be adjusted while drilling to place the wellbore in the highest percentage hydrocarbon content zone of the formation, and an increased quantity of oil and hydrocarbon gases can be produced from the formation. Fluid saturation characterization of the formations surrounding the wellbore can be measured. For example, the changes in temperatures of the formations surrounding the wellbore responsive to a heat input can be measured using the quantitative measurements and procedures.

FIG. 1A is a schematic view of a drilling assembly 100 disposed in a wellbore 102. As shown in FIG. 1A, the wellbore 102 is a horizontal wellbore. However, the wellbore 102 can be a vertical wellbore, as described in reference to FIG. 5. The wellbore 102 extends from the surface (not shown) of the Earth into the subterranean Earth 104. The subterranean Earth 104 contains pressurized liquid and gaseous phases of various fluids and chemicals including water, oils, and hydrocarbon gases. The drilling assembly 100 includes a drill bit 106. The drill bit 106 contacts a bottom surface 108 of the wellbore 102. The drill bit 106 removes portions 110 of the subterranean Earth 104 to create the wellbore 102.

The drilling assembly 100 includes a heater assembly 112. The heater assembly 112 is mechanically coupled to the drill bit 106 by a first connector 128*a* described in detail below. The heater assembly 112 transfers heat into a portion 114 of the subterranean Earth 104 surrounding the heater assembly 112 and measures a change in the subterranean Earth 104 temperature responsive to heating the portion 114 of the subterranean Earth 104. Based on a result of measuring the change in the subterranean Earth 104 temperature, the heater assembly 112 adjusts a drilling parameter of the drilling assembly 100.

The drilling assembly 100 includes a downhole conveyor 116. The downhole conveyor 116 is mechanically coupled the heater assembly 112 by a second connector 128*b*, described below in detail, of the heater assembly 112. The downhole conveyor 116 transports the heater assembly 112 into the wellbore 102 and to the bottom surface 108 of the wellbore 102. The downhole conveyor 116 rotates the drill bit 106 in contact with the bottom surface 108 to remove the portions 110 of the Earth to form the wellbore 102. The downhole conveyor 116 can be a drill pipe or a coiled tubing.

The connectors 128*a* and 128*b* can be a standard API (American Petroleum Institute) rotary shouldered pin connector. The standard API rotary shouldered connector can be a regular connection, a numeric connection, an internal flush connection, or a full hole connection. The pin connection can be a manufacturer proprietary design. The connectors 128*a* and 128*b* can be a box connection, where the threads are internal to the box. The connectors 128*a* and 128*b* can have an outer diameter corresponding to a standard American Petroleum Institute connection size. For example, the connectors 128*a* and 128*b* can have an outer diameter 130 of 4½ inches, 5½ inches, 6⅝ inches, 7 inches, 7⅝ inches, 8⅝ inches, 9⅝ inches, 10¾ inches, 11¾ inches, or 13⅜ inches.

During a drilling operation, as shown, the wellbore 102 is filled with a drilling mud 170. The drilling mud 170 maintains the structural integrity of the wellbore 102. The drilling mud 170 flows from the surface of the Earth through the downhole conveyor 116 in the direction of arrow 118. The drilling mud 170 flows out the drill bit 106 in the direction of arrows 120 and flows the removed portions 110 of the formation to the surface of the Earth in the direction of arrow 122 through an annulus 124 defined by an inner surface 126 of the wellbore 102 and an outer surface 128 of the drilling assembly 100. The drilling mud 170 can be oil based.

The heater assembly 112 includes a sleeve 132. As previously discussed, the heater assembly 112 is mechanically coupled to the drill bit 106 and the downhole conveyor 116 by the connectors 128*a* and 128*b*, respectively. The sleeve 132 is generally cylindrical. The sleeve 132 is a metal. For example, the sleeve can be steel or aluminum.

Figure 1B:
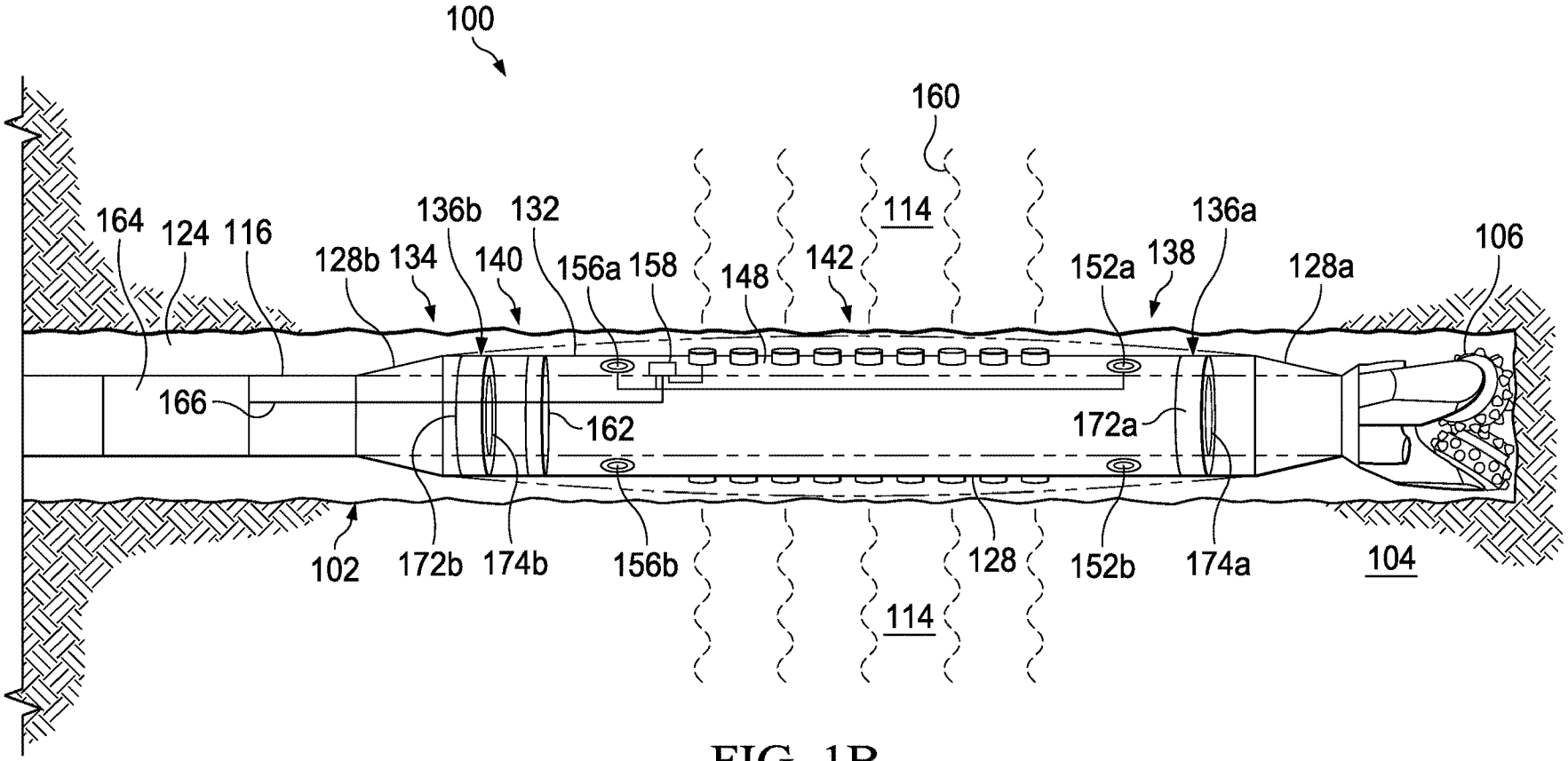
FIG. 1B is a schematic cross-sectional view of the drilling assembly including the heater assembly disposed in the wellbore of FIG. 1A.

FIG. 1B is a schematic cross-sectional view of the drilling assembly including the heater assembly 112 disposed in the wellbore of FIG. 1A. Referring to FIG. 1B, the heater assembly 112 includes a bearing assembly 134. The bearing assembly 134 includes a first bearing 136*a* and a second bearing 136*b*. The first bearing 136*a* is positioned at a first end 138 of the heater assembly 112. The first end 138 is proximal to the drill bit 106 (the drilling end of the drilling assembly 100). The first bearing 136*a* includes an outer race 172*a* mechanically coupled to the sleeve 132. The first bearing 136*a* includes an inner race 174*a* mechanically coupled to the downhole conveyor 116. The first bearing 136*a* includes ball bearings (not shown) positioned in between and rotatably coupled to the outer race 172*a* and the inner race 174*a*. The first bearing 136*a* rotatably isolates the first end 138 of the sleeve 132 from the downhole conveyor 116.

The second bearing 136*b* is positioned at a second end 140 of the heater assembly 112. The second end 140 is the distal end from the drill bit 106, that is, the second end 140 is farther from the drill bit 106 than the first end 138. The second bearing 136*b* includes a second outer race 172*b* mechanically coupled to the sleeve 132. The second bearing 136*b* includes a second inner race 174*b* mechanically coupled to the downhole conveyor 116. The second bearing 136*b* includes ball bearings (not shown) positioned in between and rotatably coupled to the second outer race 172*b* and the second inner race 174*b*. The second bearing 136*b* rotatably isolates the second end 140 of the sleeve 132 from the downhole conveyor 116. The sleeve 132 is rotatably isolated from the rotation of the downhole conveyor 116 driving the drill bit 106 (or in other words, causing the drill bit 106 to rotate) by the first bearing 136*a* and the second bearing 136*b*.

Referring to FIGS. 1A-1B, the heater assembly 112 includes a heat source 142. The heat source 142 is positioned on an outer surface 148 of the sleeve 132. In some cases, the heat source 142 includes a magnetron 144. In some cases, as shown in FIGS. 1A-1B, the heat source 142 includes multiple magnetrons 144. Magnetrons 144 generate microwaves 160 (microwave energy) when electrons are flowed across metal cavities in a vacuum tube (not shown) by a power source 164, described in detail later. The magnetrons 144 transmit microwaves 160 into the portions 114 of the subterranean Earth 104. The magnetrons 144 are oriented to transmit the microwaves 160 radially outward into the subterranean Earth. Transmitting microwaves 160 in to the portions 114 of the Earth heats the portions 114 of the Earth. As shown in FIGS. 1A-1B, the magnetrons 144 are arranged linearly relative to a longitudinal axis 146 of the sleeve 132 on the outer surface 148 of the sleeve 132. Alternatively, the magnetrons 144 can be arranged in multiple circles or multiple sets of lines. The magnetrons 144 can be arranged to increase magnetron 144 density across the outer surface 148 from the first end 138 to the second end 140, or to decrease magnetron 144 density across the outer surface from the first end 138 to the second end 140.

The microwaves 160 penetrate the subterranean Earth 104. For example, the microwaves 160 can penetrate up to 0.5-2 meters. The microwaves 160 penetrate the subterranean Earth 104 based, in part, upon formation lithology, formation porosity, formation fluid content, and microwave frequency. When the magnetrons 144 heat the portion 114 of the subterranean Earth 104 by generating microwaves 160, polar molecules (not shown) of the subterranean Earth 104 which have an electrical dipole moment, for example, water molecules, start to generate thermal energy as a result of a dipole rotation of the water molecules. The drilling mud 170 flows up the annulus 124 between the wellbore 102 and the drilling assembly 100, removing heat from the subterranean Earth 104, thus the drilling mud 170 temperature increases. Water has a higher heat conductivity than oil, which also increases heat transfer from the portion 114 of the subterranean Earth 104 back into the drilling mud 170.

The heater assembly 112 includes multiple bars 150. The bars 150 are positioned on and extend from the outer surface 148 of the sleeve 132. The bars 150 engage the inner surface 126 of the wellbore 102 and slide across the inner surface 126. When the bars 150 slide across the inner surface 126 of the wellbore 102, the bars 150 oppose rotational forces acting on the sleeve 132 to keep the sleeve 132 from rotating in the wellbore 102 as the downhole conveyor 116 rotates within the sleeve 132. The sleeve 132 is isolated from the rotation of the downhole conveyor 116 by the first bearing 136*a* and the second bearing 136*b* as described earlier.

The magnetrons 144 are positioned in between the bars 150 to protect the magnetrons 144. A top surface 176 of the magnetrons 144 is between the outer surface 148 of the sleeve 132 and a top surface 178 of the bars 150. In other words, the top surface 178 of the bars 150 extends closer to the inner surface 126 of the wellbore 102 than the top surface 176 of the magnetrons 144. This can protect the magnetrons 144 from damage from impacting the subterranean Earth 104.

The heater assembly 112 includes a first sensor 152*a* positioned at or near the first end 138 of the heater assembly 112. For example, as shown, the first sensor 152 is positioned on the sleeve 132. Alternatively, the first sensor 152 can be positioned on the first connector 128*a*. The first sensor 152*a* senses a first condition of the drilling mud 170 which corresponds to the condition of the subterranean Earth 104 at a depth 154 in the wellbore 102. The first condition is temperature of the drilling mud 170 at the depth 154.

Logging while drilling (LWD) tools (not shown) and operations measure gamma rays (GR) received from the portion 114 of the subterranean Earth 104. Gamma ray measurements from the portion 114 of the subterranean Earth 104 can be used to qualitatively identify formation lithology. LWD tools and operations also measure formation density, neutron porosity, and electromagnetic resistivity of the formation. Density logs and neutron logs are used to determine formation porosity. Electromagnetic resistivity measurements are used to differentiate and quantify formation water from hydrocarbons. Temperature measurement, as described here, are incorporated into the gamma ray, formation density, neutron porosity, and electromagnetic resistivity logs, which are more conventional measurement methods and tools, for increased accuracy of formation evaluation, especially when formation water is fresh water where resistivity measurements loss sensitivity in differentiating formation water from hydrocarbons.

The first sensor 152*a* transmits a signal representing a value of the first temperature of the drilling mud 170 corresponding to the first temperature of the portion 114 of the subterranean Earth 104 at the depth 154 before the magnetrons 144 heat the portion 114 of the subterranean Earth 104. The first sensor 152*a* is positioned on the heater assembly 112 at or near the first end 138 such that, when the magnetrons 144 are turned on (transmitting the microwaves 160) the temperature increase of the portion 114 of the subterranean Earth is not sensed through the drilling mud 170 by the first sensor 152*a* due to the drilling mud 170 fluid flow not crossing the heated portion 114 of the subterranean Earth 104 and a distance 180 between the magnetrons 144 and the first sensor 152*a*.

The heater assembly 112 can include multiple first sensors 152*a*. For example, the first sensor 152*a* and another first sensor 152*b* can be arranged with 180 degrees of separation in a plane about the longitudinal axis 146. For example, three first sensors 152*a* can be arranged with 120 degrees of separation in a plane about the longitudinal axis 146. The multiple first sensors 152*a* and 152*b* measure the temperature in the portion 114 of the subterranean Earth 104 in multiple directions around the heater assembly 112. The multiple first sensors 152*a* and 152*b* measure the temperature in the portion 114 of the subterranean Earth 104 in multiple directions around the heater assembly 112.

The heater assembly 112 includes a second sensor 156*a*. The second sensor 156*a* is positioned at the second end 140 of the sleeve 132. The second sensor 156*a* senses a second condition of the drilling mud 170 crossing the heated portion 114 of the subterranean Earth 104 after the drilling assembly 100 drills the wellbore 102 and the magnetrons 144 heat the portion 114 of the subterranean Earth 104. In other words, the second sensor 156*a* senses the drilling mud temperature responsive to the drilling mud 170 receiving heat back from the portion 114 of the subterranean Earth 104 by the flow of the drilling mud 170. The second condition is a second temperature of the drilling mud 170 after the magnetrons 144 have heated the portion 114 of the subterranean Earth 104. The second sensor 156*a* is positioned on the heater assembly 112 at or near the second end 140 such that, when the magnetrons 144 are turned on (transmitting the microwaves 160), the temperature increase of the portion 114 of the subterranean Earth is sensed through the drilling mud 170 by the second sensor 156*a*. The sensed temperature is affected by multiple factors such as the drilling mud 170 fluid flow rate and properties, the movement of the drilling assembly 100 through the wellbore 102 (rate of penetration), wellbore 102 properties, and a distance 182 between the magnetrons 144 and the second sensor 156*a*. These factors are described later in reference to FIGS. 7-10. The drilling mud 170 flowing through the annulus 124 acts like a heat exchanger, so that when the drilling mud 170 passes by the heated portion 114, the drilling mud 170 gains heat from the heated portion 114, and the increased in drilling mud 170 temperature is sensed by the second sensor 156*a*.

The second sensor 156*a* transmits a signal representing a value of the second temperature of the drilling mud 170 corresponding to the heated portion 114 of the subterranean Earth 104. The heater assembly 112 can include multiple second sensors 156*a*. For example, the second sensor 156*a* and another second sensor 156*b* can be arranged with 180 degrees of separation in a plane about the longitudinal axis 146. For example, three second sensors 156*a* can be arranged with 120 degrees of separation in a plane about the longitudinal axis 146. The multiple second sensors 156*a* and 156*b* measure the temperature in the portion 114 of the subterranean Earth 104 in multiple directions around the heater assembly 112.

The sensors 152*a* and 156*a* contact the drilling mud 170 and are spaced from the inner surface 126 of the wellbore 102. The heat from the magnetrons 144 is transferred back into the drilling mud 170 by conduction. The sensors 152*a* and 156*a* sense the change in the temperature of the drilling mud 170.

Referring to FIG. 1B, the heater assembly 112 includes a controller 158. The controller 158 can include a computer (not shown) with a microprocessor. The controller 158 has one or more sets of programmed instructions stored in a memory or other non-transitory computer-readable media that stores data (e.g., connected with the printed circuit board), which can be accessed and processed by a microprocessor. The programmed instructions can include, for example, instructions for sending or receiving signals and commands to operate the magnetrons 144 and/or collect and store data from the sensors 152*a* and 156*a*. The controller 158 stores values (signals and commands) against which sensed values (signals and commands) representing the condition are compared. The controller 158 is electrically coupled to and powered by a power source 164 described below.

The controller 158 receives the signal from the first sensor 152*a* representing the value of the first temperature of the drilling mud 170 at the depth 154. The controller 158 receives the signal from the second sensor 156*a* representing the value of the second temperature of the drilling mud 170 after the magnetrons 144 heat the portion 114 of the subterranean Earth 104. The controller 158 stores the value of the first temperature at the depth 154 and the value of the second temperature. The first temperature value is compared to the second temperature value. The result of the comparison is a drilling mud temperature differential value.

The controller 158 stores a drilling mud threshold differential temperature value. The drilling mud threshold differential temperature value is compared to the drilling mud differential temperature value as described in more detail below in regards to FIGS. 7-14. The drilling mud differential temperature threshold value is chosen and stored in the controller 158 such that a comparison between the drilling mud temperature differential value and the drilling mud threshold differential temperature value will effectively communicate when the drilling assembly 100 is in a target zone 202 of the formation (described later in reference to FIG. 2) or another zone 302 of the formation (described later in reference to FIG. 3) other than the target zone 202 of the formation (the oil-bearing formation or the water-bearing formation, respectively).

Referring to FIG. 1B, the heater assembly 112 includes an electrical slip ring 162. The electrical slip ring 162 is positioned within the sleeve 132. The electrical slip ring 162 transfers electricity from a power source 164 to the magnetrons 144 through controller 158 via a power cable 166 while the drilling assembly 100 rotates and the sleeve 132 and the magnetrons 144 do not rotate. As shown in FIG. 1B, the power source 164 can be a power sub-assembly positioned in the drilling assembly 100 such as a downhole power mud turbine or batteries. Alternatively, the power source 164 can be positioned on the surface of the Earth and the electrical power can be conducted through the drilling assembly 100 by the power cable 166. For example, the power source 164 can be a gas powered generator.

The electrical slip ring 162 also transfers the signals from the first sensor 152*a* and the second sensor 156*a* representing the values of the first temperature of the drilling mud 170 and the second temperature of the drilling mud 170 after the drilling mud 170 crosses the heated portion 114 of the formation to another controller (not shown) on the surface of the Earth.

Figure 2:
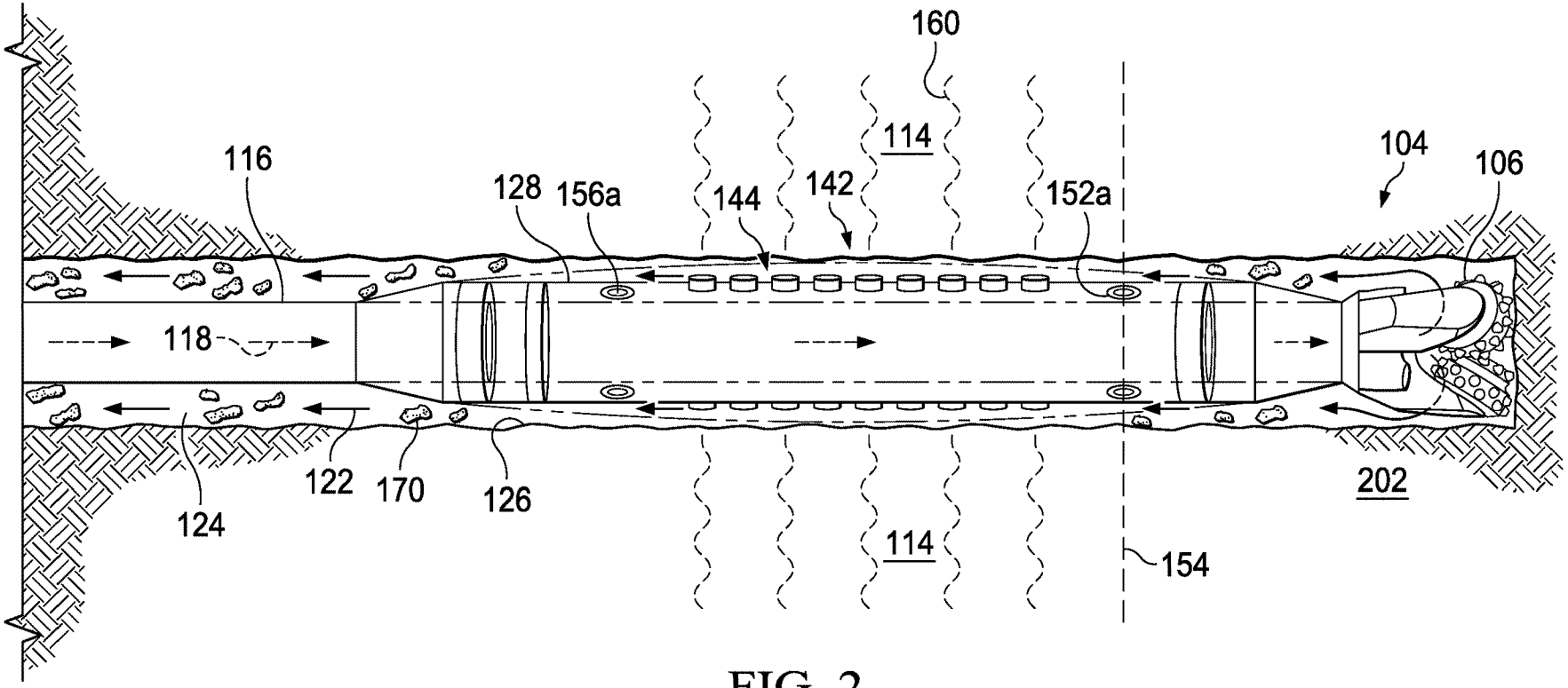
FIG. 2 is a schematic of view of the drilling assembly including the heater assembly of FIG. 1A drilling in a target formation through an oil-bearing zone.

FIG. 2 is a schematic of view of the drilling assembly 100 including the heater assembly 112 of FIG. 1A drilling in a target zone 202 of the formations of the subterranean Earth 104. The controller 158 compares the value of the first drilling mud 170 temperature and the value of the second drilling mud 170 temperature. When the controller 158 determines that the difference between the value of the first drilling mud 170 temperature and the value of the second drilling mud 170 temperature is less than the threshold temperature difference value, then the controller 158 determines that the drilling assembly 100 is in the target zone 202 of the subterranean Earth 104. A target zone is the portion 114 of the subterranean Earth 104 in which an operator of the drilling assembly 100 planned to place the wellbore 102. In this case, the target zone is the target zone 202 of the subterranean Earth 104.

Figure 3:
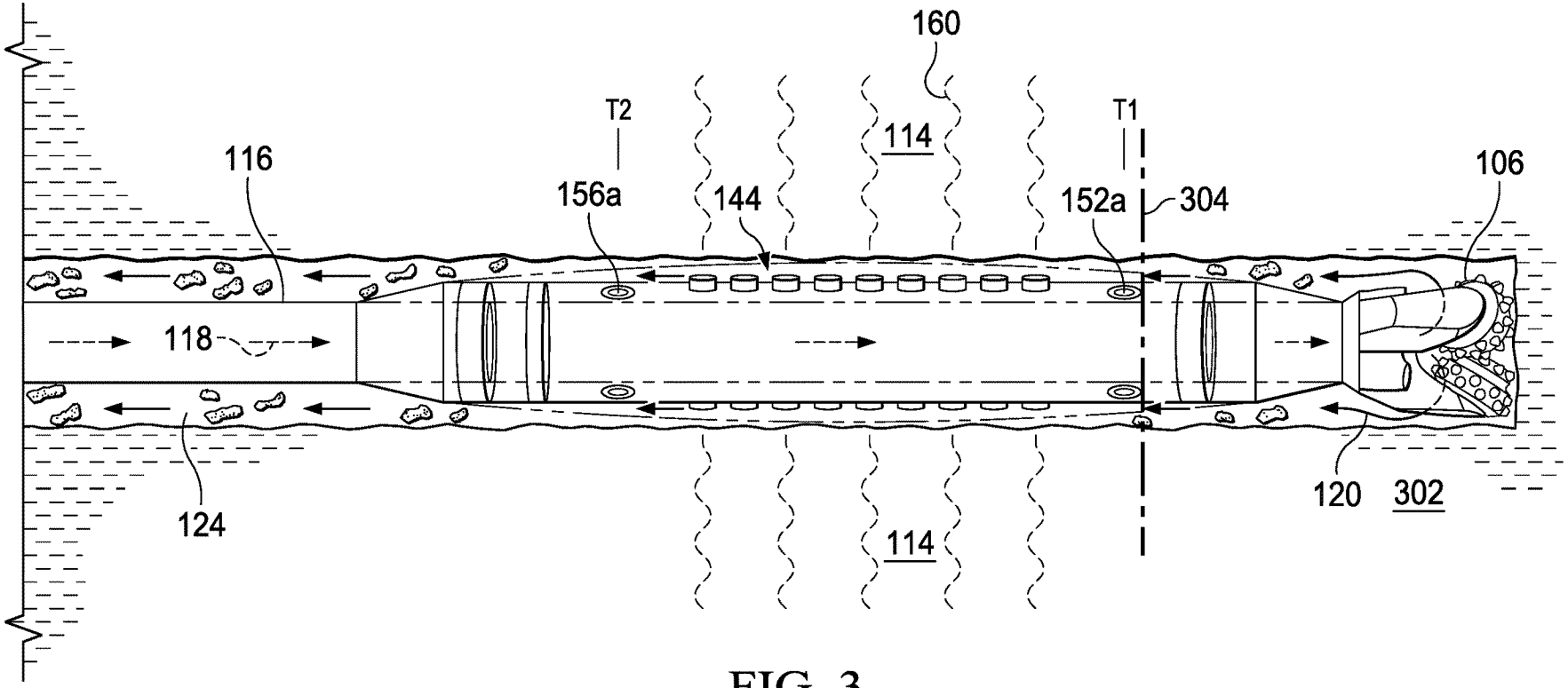
FIG. 3 is a schematic of view of the drilling assembly including the heater assembly of FIG. 1A drilling in a target formation through a water-bearing zone.

FIG. 3 is a schematic of view of the drilling assembly 100 including the heater assembly 112 of FIG. 1A drilling in another zone 302 of the formation other than the target zone 202. The other zone 302 other than the target zone 202 can be a water-bearing formation or water-bearing zone of the target formation. Referring to FIG. 3, the depth 154 is a first depth 154 (as shown in FIGS. 1A-2). At a second depth 304 different than the first depth 154, the drilling assembly 100 is drilling in the other zone 302. The controller 158 compares the difference between the value of the first drilling mud 170 temperature and the value of the second drilling mud 170 temperature to the drilling mud 170 threshold temperature difference value. When the controller 158 determines that the difference between the value of the first drilling mud 170 temperature and the value of the second drilling mud 170 temperature is greater than the drilling mud 170 threshold temperature difference value, then the controller 158 determines that the drilling assembly 100 is in the other zone 302 of the subterranean Earth 104.

As shown in FIG. 3, when drilling assembly 100 drills through the other zone 302, microwaves 160 heat up the water in the portion 114 around the wellbore 102 and the generated heat can propagate back to the drilling mud 170. The drilling mud 170 flows inside the downhole conveyor 116 in the direction of arrow 118. The drilling mud 170 then flows through the drill bit 106 in the direction of arrows 120 and out into the wellbore 102, where the drilling mud 170 gains some heat as it cools down the drill bit 106. Then, the drilling mud 170 passes by the first temperature sensor where the temperature of the drilling mud 170 is sensed. After that, the drilling mud 170 passes by the heated portion 114 of the subterranean Earth 104 along the inner surface 126 of the wellbore 102 and acts like a heat exchanger to gain more heat until it passes by the second temperature sensor 156*a* to measure the second temperature. The differential temperature, $$\Delta T = T2 - T1, \qquad \text{Equation 1:}$$

is then calculated where the differential temperature is at least higher than the differential temperature threshold value. For example, the differential temperature threshold value can be 1° C. The differential temperature threshold value can be adjusted based on formation thermal properties, formation physical properties (such as porosity, permeability, wettability, fluid type, and fluid properties), mud thermal properties, mud flowrate, magnetrons 144 power and microwave 160 exposure time.

When the drilling assembly 100 drills through the oil-bearing target formation 202 as shown in FIG. 2, the microwave 160 heating will be very slow since oil molecules are not polar like the water molecules. Some heating can occur due to the existence of an irreducible water saturation in the oil-bearing formation which is typically around 20% or less out of total pore volume, depending on rock quality and relative location above free water level. Therefore, the differential temperature will be lower than the differential temperature threshold value (such as 1° C.) and may be close to zero depending on formation and mud properties and microwave exposure time discussed previously. So, when the differential temperature is less than the differential temperature threshold value, the drilling assembly 100 is in the target zone 202 (the oil-bearing formation).

In some cases, a high exposure time may increase the differential temperature in target zone 202 to the differential temperature threshold value (such as 1° C. and above) due to the existence of the irreducible water saturation. Similar exposure time in the other zone 302 would be comparatively higher assuming no change in formation/mud properties and mud flow rate.

Figure 4:
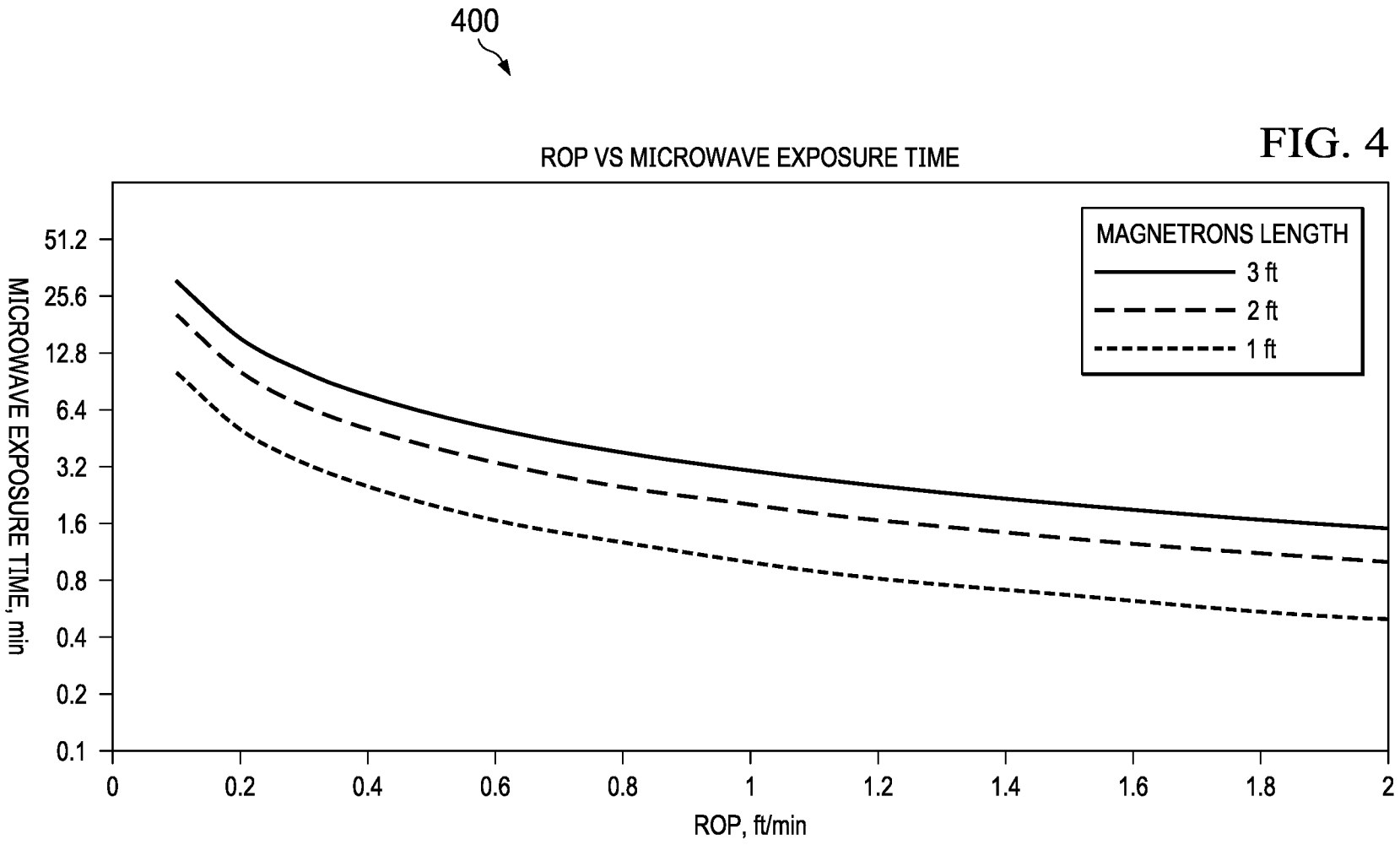
FIG. 4 is a graph of microwave exposure time vs. ROP and magnetron row length.

FIG. 4 is a graph of microwave exposure time vs. ROP and magnetron row length. Multiple magnetrons 144 are used to raise the temperature of the portion 114 of the formation as quickly and as high as possible to maintain a high formation temperature in the water-bearing zone and to have a better heat transfer rate back to the drilling mud 170. The higher the differential temperature ($\Delta T(=T_{formation}-T_{mud})$), the higher the rate of heat transfer. Referring to FIGS. 1A and 4, microwave 160 exposure time is a function of magnetrons' 144 row length 168 (shown in FIG. 1A) and drilling rate of penetration (ROP) through the subterranean Earth 104. The longer the magnetrons' 144 row length 168, the higher the exposure time. The slower the ROP, the higher the exposure time. Magnetrons 144 row length 168 can be selected based on expected average ROP for sufficient exposure time to heat the portion 114 of the subterranean Earth 104. The ROP can be dynamically adjusted by the operator of the drilling assembly from the surface of the Earth 104. The higher the exposure time, the higher the heat temperature generated by microwave heating of the portion 114 of the subterranean Earth 104. Additionally, the heat generated in the portion 114 of the subterranean Earth 104 depends on the lithology and physical characteristics of the subterranean Earth 104 which are accounted for and described in regards to FIGS. 7-14 below.

Based on a result of the comparison (as described in reference to FIGS. 2 and 3), the controller 158 generates a status signal which is sent to anther controller (not shown) which is controlling the drilling assembly 100. The other controller which is controlling the drilling assembly 100 can be positioned in the drilling assembly 100 or on the surface of the Earth. For example, as shown in reference to FIG. 2, responsive to determining when the difference between the value of the first temperature and the value of the second temperature is less than the threshold difference value, the controller 158 transmits the status signal that the drilling assembly 100 is in the target zone 202 (the target formation) and should be maintained in the target zone 202. Alternatively, for example, as shown in reference to FIG. 3, the controller 158, responsive to determining that the difference between the value of the first temperature and the value of the second temperature is greater than the threshold temperature difference value, the controller 158 generates another status signal which is sent to the other controller that the drilling assembly 100 is no longer in the target zone 202 and to steer the drilling assembly 100 from the other zone 302 back to the target zone 202. Steering the drilling assembly 100 can also be referred to as geo-steering. For example, the other controller can command the drilling assembly 100 to maintain or change a weight on bit, a revolution per minute, a tool face orientation, a drilling direction, or a drilling azimuth of the drilling assembly 100. For example, the other controller can command a change of a flow rate of the drilling mud 170.

Figure 5:
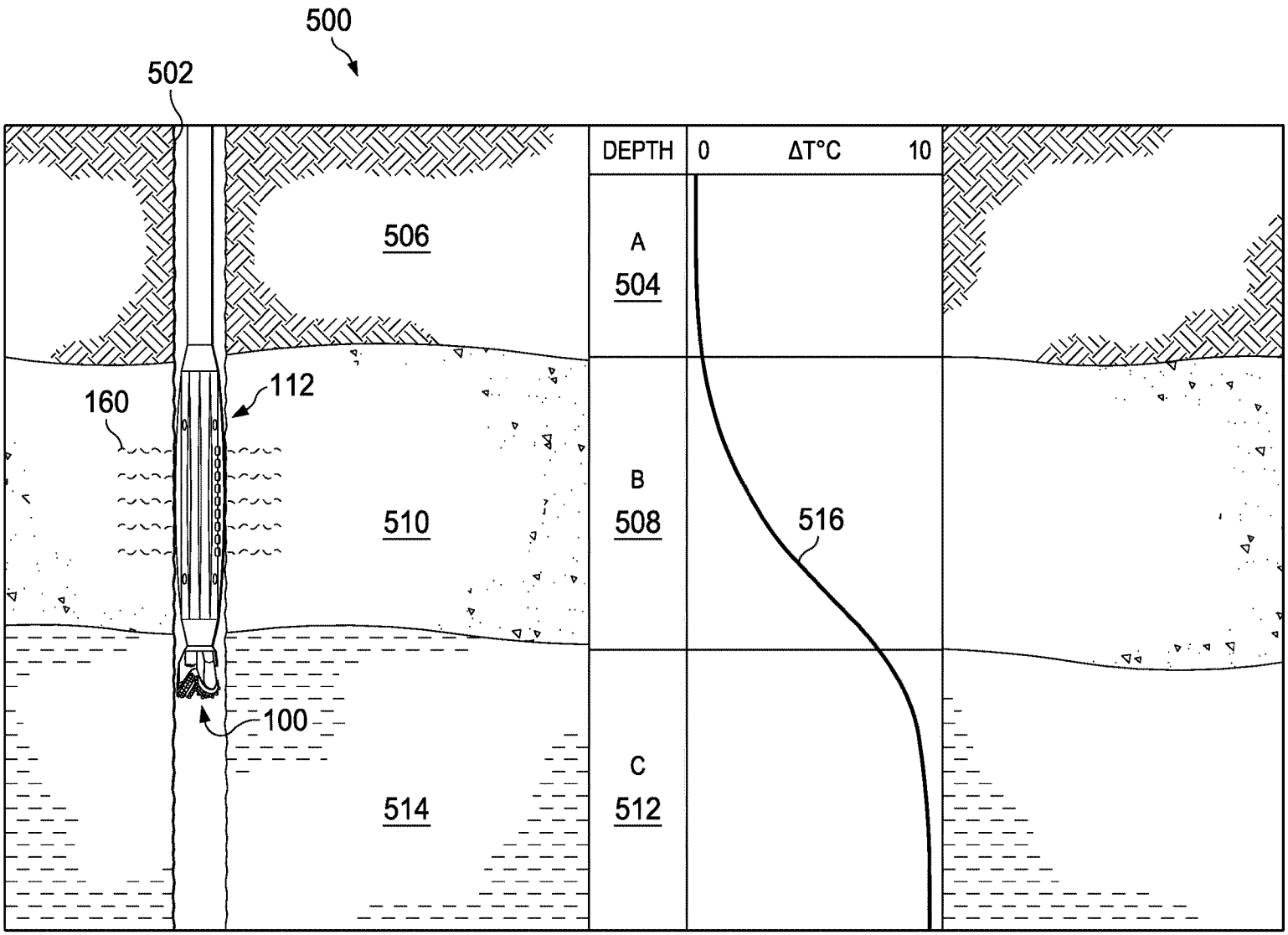
FIG. 5 is a graph of drilling mud differential temperature vs. depth through various formation's zones while drilling a vertical wellbore with the drilling assembly of FIG. 1A.

FIG. 5 is a graph 500 of drilling mud differential temperature vs. depth through various zones of formations while drilling a vertical wellbore 502 with the drilling assembly 100 of FIG. 1A. Referring to FIG. 5, a depth zone "A" 504 is a target formation 506. The target formation 506 can be an oil-bearing formation at an irreducible water concentration. A depth zone "C" 512 is a third formation 514 outside the target formation 506. The third formation 514 outside the target formation 506 can be a water-bearing formation. A depth zone "B" 508 is a second formation 510 outside the target formation 506 and the third formation 514. The second formation 510 outside the target formation 506 and the third formation 514 can be a transition formation. That is, the second formation 510 outside the target formation 506 and the third formation is a mixture of oil-bearing and flowing and water-bearing and flowing formations, with an increasing quantity of water as the depth of the vertical wellbore 502 transitions through depth zone "B" 508.

As the drilling assembly 100 drills the vertical wellbore 502, the first temperature sensor 152*a* continuously senses the first temperature of the drilling mud 170 and transmits the signal representing the value of the first temperature of the drilling mud 170 to the controller 158 (shown in FIG. 1B). The controller 158 stores the values of the first temperature of the drilling mud 170 at each depth. The heater assembly 112 transmits microwaves 160 in the formations 506, 510, and 514, sequentially heating the various formations 506, 510, and 514. The second temperature sensor 156*a* continuously senses the second temperature of the drilling mud 170 and transmits the signal representing the value of the second temperature of the drilling mud 170 to the controller 158 (shown in FIG. 1B). The controller 158 stores the vales of the second temperature of the drilling mud 170 at each depth. The controller 158 compares the first temperature of the drilling mud 170 to the second temperature of the drilling mud 170 to determine the differential temperature 516. The differential temperature 516 is graphed from 0° C. increasing to 10° C. as the drilling assembly 100 drills from the target formation 506, through the second formation 510, and into the third formation 514.

Figure 6:
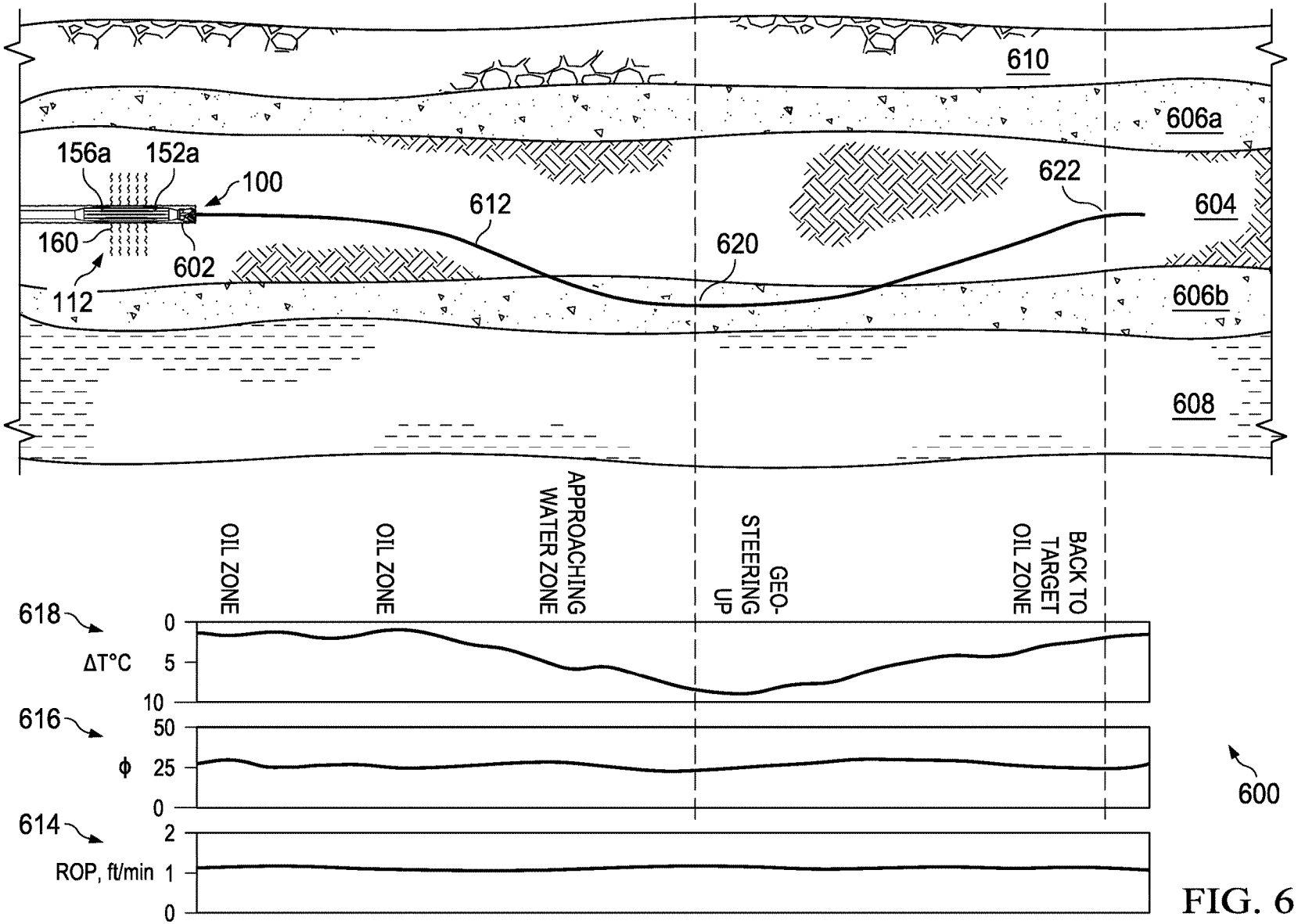
FIG. 6 is a graph of drilling mud differential temperature, porosity, and ROP while drilling a horizontal wellbore with the drilling assembly of FIG. 1A.

FIG. 6 is a graph 600 of temperature, porosity, and ROP while drilling a horizontal wellbore 602 with the drilling assembly 100 of FIG. 1A. The horizontal wellbore 602 drilled in a target formation 604. The target formation 604 is an oil-bearing formation at an irreducible water concentration. The target formation 604 is bounded above and below by second formations 606*a* and 606*b*, respectively, substantially similar to the second (transition) formation described earlier. Below the second formations 606*b* is another formation 608, substantially similar to the other formations previously described. Above the second formation 606*a* is a third formation 610. The third formation 610 can be a cap rock formation. The third formation 610 has a very low porosity compared to the adjacent formations, for example, the second formation 606*a*, and is generally unfractured. The third (cap rock) formation 610 has an extremely low permeability compared to the adjacent formations, for example the second formation 606*a*, so oil from the target formation 604 and/or water from the second formation 606*a* will not flow into or through the third formation 610.

A drilling path 612 is shown through the various formations. The drilling path 612 is a result of steering the drilling assembly 100 (the geo-steering operation) as previously described based on the measurements from heating the portion 114 of the subterranean Earth 104. A projected (that is, pre-planned or planned) drilling path (not shown) is generally straighter (smoother) and within the target formation 604. Since the planned drilling path is based on best geological estimations, the drilling path 612 can deviate from the projected drilling path based on actual formation changes.

A graph 614 of the ROP in feet per minute shows that the ROP is maintained generally constant. A graph 616 of the porosity along the projected drilling path 612 shows that the porosity of the target formation 604 and into the second formation 606*b* is generally constant. Logging tools measuring the porosity may not detect the change of the drilling assembly 100 moving from the target formation 604 into the second formation 606*b*, that is, the drilling assembly 100 is no longer in the target zone. However, as the drilling assembly 100 drills the horizontal wellbore 602 along the projecting drilling path 612, the heater assembly 112 transmits microwaves 160 (energy) into the formations 604 and 606*b* along the projected drilling path 612.

As the drilling assembly 100 drills the horizontal wellbore 602, the first temperature sensor 152*a* continuously senses the first temperature and transmits the signal representing the value of the first temperature to the controller 158 (shown in FIG. 1B). The controller 158 stores the values of the first temperature at each depth. The second temperature sensor 156*a* continuously senses the second temperature and transmits the signal representing the value of the second temperature to the controller 158 (shown in FIG. 1B). The controller 158 stores the values of the second temperature at each depth. The controller 158 compares the first temperature to the second temperature to determine the differential temperature, as shown in graph 618. The differential temperature is graphed from 0° C. increasing to 10° C. as the drilling assembly 100 drills from the target formation 604 and into the second formation 606*b*. At location 620, the difference between the first temperature value and the second temperature value is equal to or greater than the threshold differential temperature value. For example, the difference is 10° C. The controller 158 generates the command signal to the drilling assembly 100 to steer the drilling assembly 100 from the second formation 606*b* back to the target formation 604. For example, the command signal and re-orient the tool face orientation of the drilling assembly 100 toward the target formation 604.

The re-oriented drilling assembly 100 continues to drill the horizontal wellbore 602 along the projected drilling path 612 back toward the target formation 604 (the oil-bearing formation). The heater assembly 112 continues to heat the adjacent formation. The differential temperature between the first temperature sensor 152*a* and the second temperature sensor 156*a* begins to decrease, as shown in graph 618. When the drilling assembly 100 returns to the target formation 604 at location 622, the differential temperature is approximately 0° C. or less than 1° C.

Figure 7:
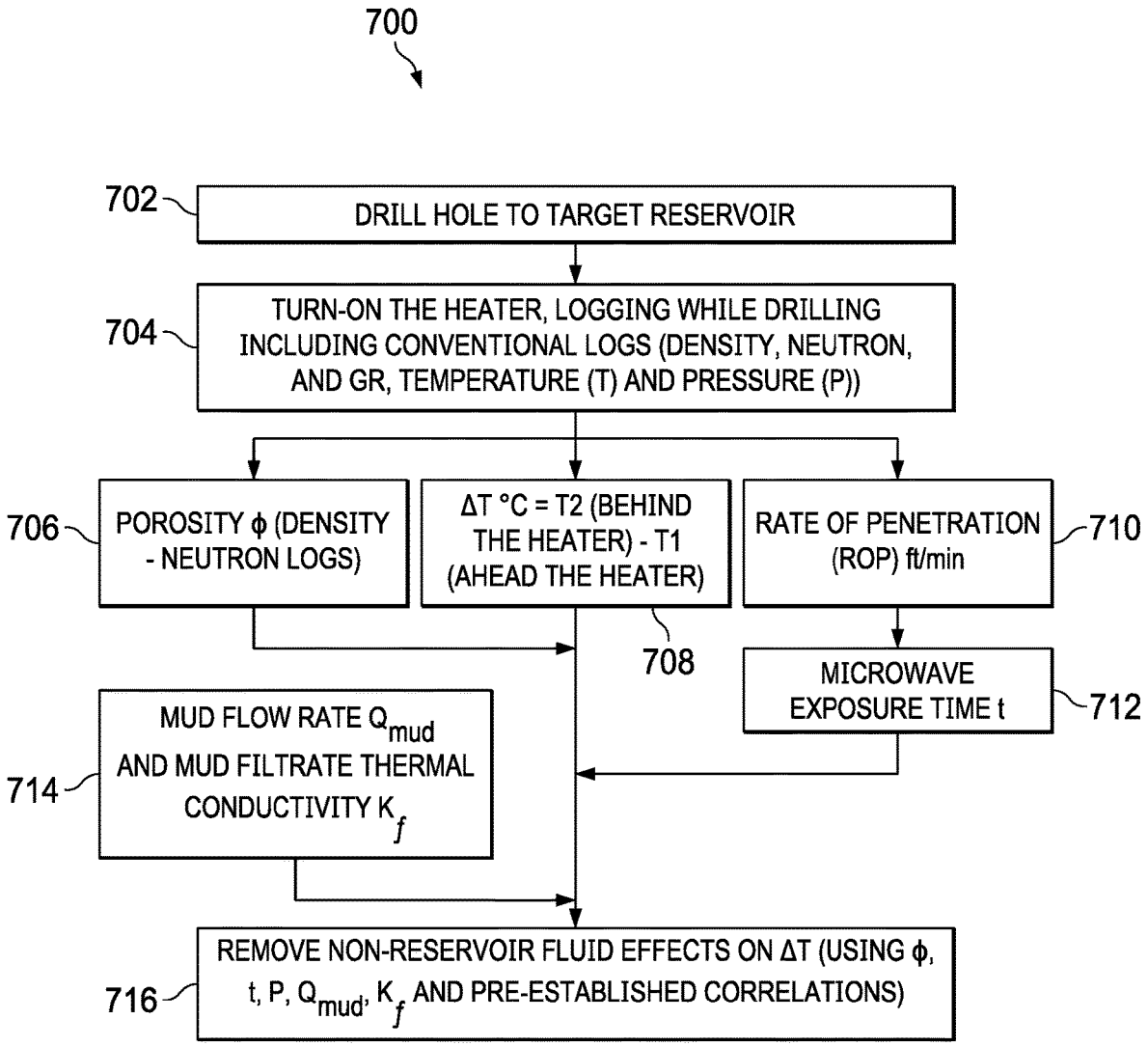
FIG. 7 is a flow chart of an example method of drilling a vertical wellbore using qualitative measurements with the drilling assembly of FIG. 5.

FIG. 7 is a flow chart of an example method 700 of drilling a vertical wellbore 502 using qualitative measurements with the drilling assembly 100 of FIG. 5. Referring to FIGS. 5 and 7, the following abbreviations are used: P—Pressure, T: Temperature, Φ—porosity, ROP—Rate of Penetration, GR—Gamma Ray, t=Exposure time of heating, $Q_{mud}$—Mud flow rate, and $K_f$—mud filtrate thermal conductivity. At 702, the drilling assembly 100 drills the vertical wellbore 502.

At 704, the heater assembly 112 is turned on. The drilling assembly 100 includes a logging tool (not shown) to perform density, neutron, electromagnetic resistivity and gamma ray logs of the formations, a drilling mud 170 temperature survey with the heater assembly 112, and pressure log of the vertical wellbore 502 fluids. One of the outputs of the logging and measurements of step 704 are porosity values 706 (from the density and neutron logs). Other outputs of the logging and measurements of step 704 include the differential temperature values 708.

At 710, the rate of penetration of the drilling assembly 100 to form the vertical wellbore 502 is measured. Referring to FIGS. 4-5, and 7, at 712, the measured rate of penetration from step 702 is used with FIG. 4 to determine the microwave exposure time. At 714, the mud flow rate and mud filtrate thermal conductivity are measured.

At 716, the non-reservoir (for example, the target formation 506—the target zone) fluid effects (porosity values from 706, microwave exposure time from 712, and the mud flow rate and mud filtrate thermal conductivity from 714) are removed from the determination of the differential temperature between the first temperature sensor 152*a* and the second temperature sensor 156*a* using pre-established correlations.

Figure 8:
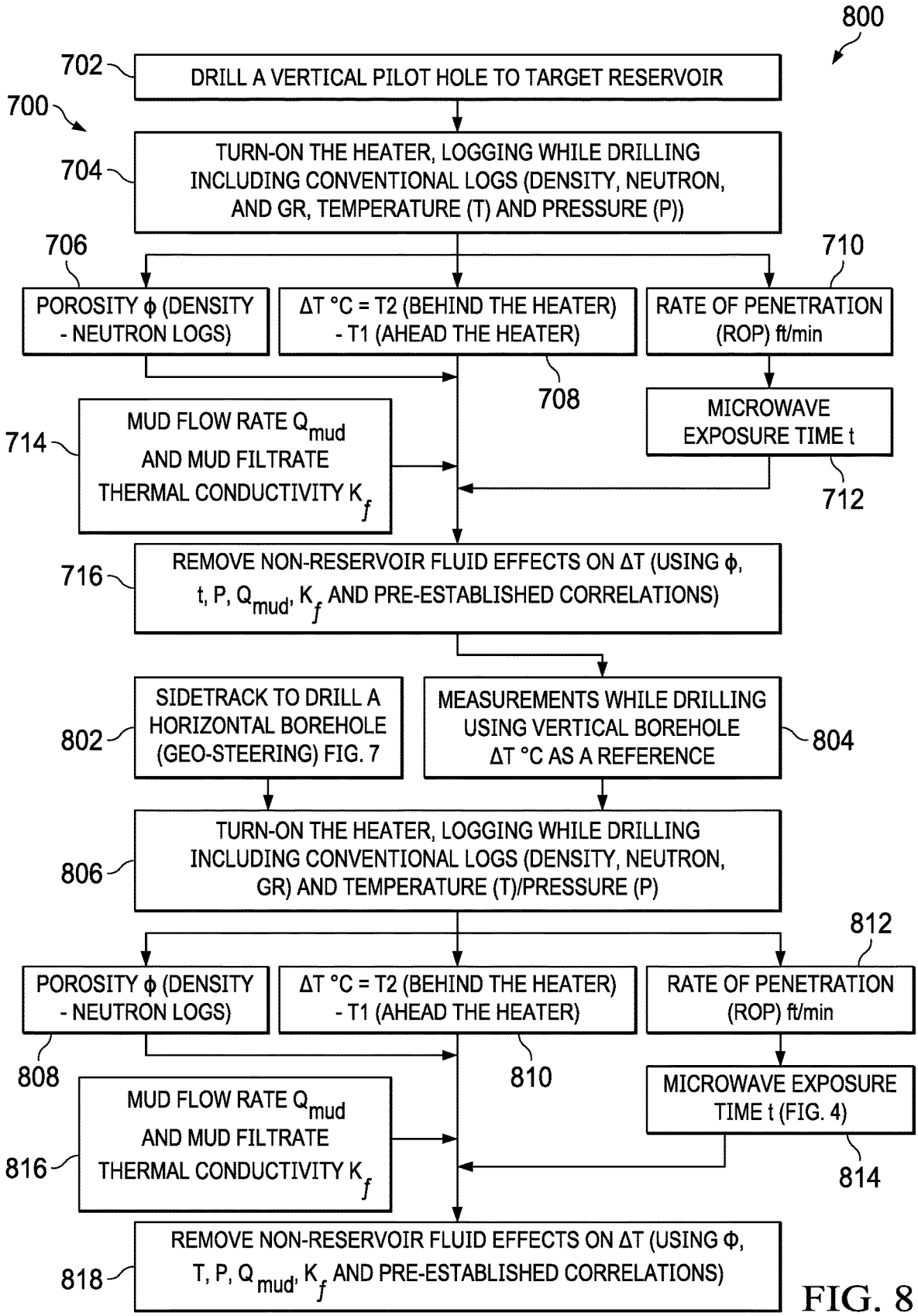
FIG. 8 is a flow chart of an example method of drilling a horizontal wellbore using qualitative measurements with the drilling assembly of FIG. 6.

FIG. 8 is a flow chart of an example method 800 of drilling a horizontal wellbore 602 using qualitative measurements with the drilling assembly 100 of FIG. 6. The qualitative methods and measurements described in reference to FIGS. 4-8 are sufficient for horizontal wellbore 602 placement. The method 800 uses the output of method 700 as the horizontal wellbore 602 of FIG. 6 extends from the vertical wellbore 502 of FIG. 5. Referring to FIGS. 5-8, at 802, the horizontal wellbore 602 is drilled from the vertical wellbore 502. For example, the drilling assembly 100 can sidetrack or kick off from the vertical wellbore 502 to drill the horizontal wellbore 602. This can be referred to as steering or geo-steering.

At 804, the outputs of example method 700 are received. The formation differential temperature with the non-reservoir fluid effects (porosity values from 706, microwave exposure time from 712, and the mud flow rate and mud filtrate thermal conductivity from 714) removed are received from method 700.

At 806, the heater assembly 112 is turned on, transmitting energy into the formations. The logging tool performs the density, neutron, resistivity, and gamma ray log of the formations. The temperature and pressure log of the horizontal wellbore 602 fluids are performed.

At 808, one of the outputs is the porosity values (from the density and neutron logs). At 810, another of the outputs of the logging and measurements of step 806 are the differential temperature values.

At 812, the rate of penetration of the drilling assembly 100 to form the horizontal wellbore 602 is measured. Referring to FIGS. 4-8, at 814, the measured rate of penetration from step 812 is used with FIG. 4 to determine microwave exposure time. At 816, the mud flow rate and mud filtrate thermal conductivity is measured.

At 818, the non-reservoir (for example, the target formation 604—the target zone) fluid effects (porosity values 808, microwave exposure time 814, and the mud flow rate and mud filtrate thermal conductivity 816) are removed or corrected for (using the pre-established correlations) from the determination of the differential temperature between the first temperature sensor 152*a* and the second temperature sensor 156*a*.

Figure 9:
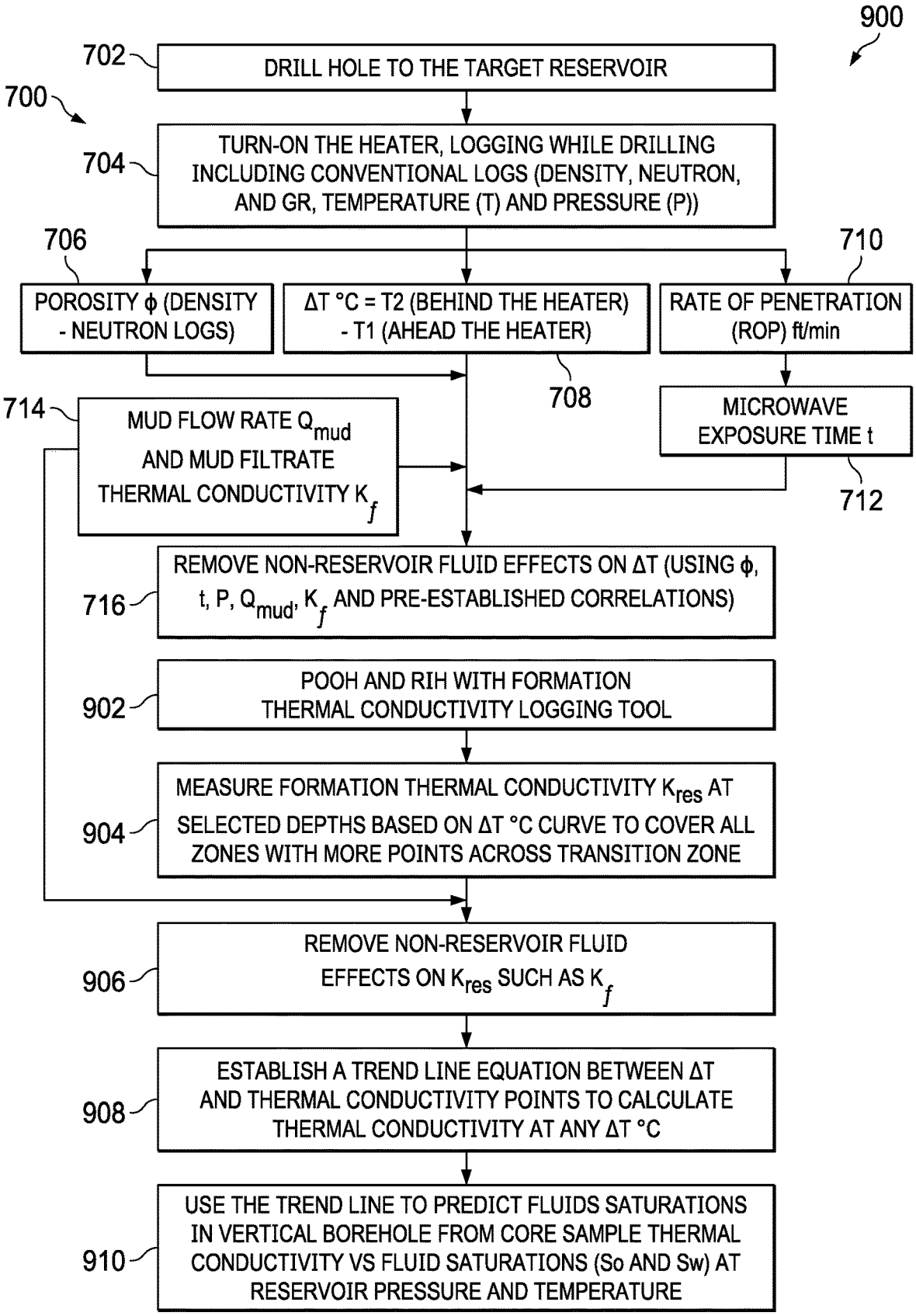
FIG. 9 is a flow chart of an example method of drilling a vertical wellbore using quantitative measurements with the drilling assembly of FIG. 5.

FIG. 9 is a flow chart of an example method 900 of drilling a vertical wellbore 502 using quantitative measurements with the drilling assembly 100 of FIG. 5. Method 900 includes method 700, steps 702-716. Referring to FIGS. 4-5, 7, and 9, at 702, the drilling assembly 100 drills the vertical wellbore 502. At 704, the heater assembly 112 is turned on. The logging tool performs the density, neutron, resistivity, and gamma ray log of the formations and a temperature and pressure log of the vertical wellbore 502 fluids. The heater assembly 112 senses the drilling mud 170 temperatures previously described. One of the outputs of the logging and measurements of step 704 are porosity values 706 (from the density and neutron logs). At 708, another of the outputs of the outputs of the logging and measurements of step 704 are the differential temperature values.

At 710, the rate of penetration of the drilling assembly 100 to form the vertical wellbore 502 is measured. The measured rate of penetration from step 702 is used with FIG. 4 to determine microwave exposure time. At 714, the mud flow rate and mud filtrate thermal conductivity is measured. At 716, the non-reservoir (for example, the target formation 506—the target zone) fluid effects (porosity values from 706, microwave exposure time from 712, and the mud flow rate and mud filtrate thermal conductivity from 714) are removed from the determination of the differential temperature between the first temperature sensor 152*a* and the second temperature sensor 156*a* using pre-established correlations.

Referring to FIG. 9, at 902, the drilling assembly 100 is pulled out of the vertical wellbore 502 and a formation thermal conductivity logging tool (not shown) is positioned in the vertical wellbore 502. At 904, the formation thermal conductivity logging tool measures the formation thermal conductivity, $K_{res}$. The formation thermal conductivity can be measured at selected depths based on the differential temperature curve to cover all formations and for more measurement points across formations and zones of formations (transitions in between target formations and other formations).

Figure 11:
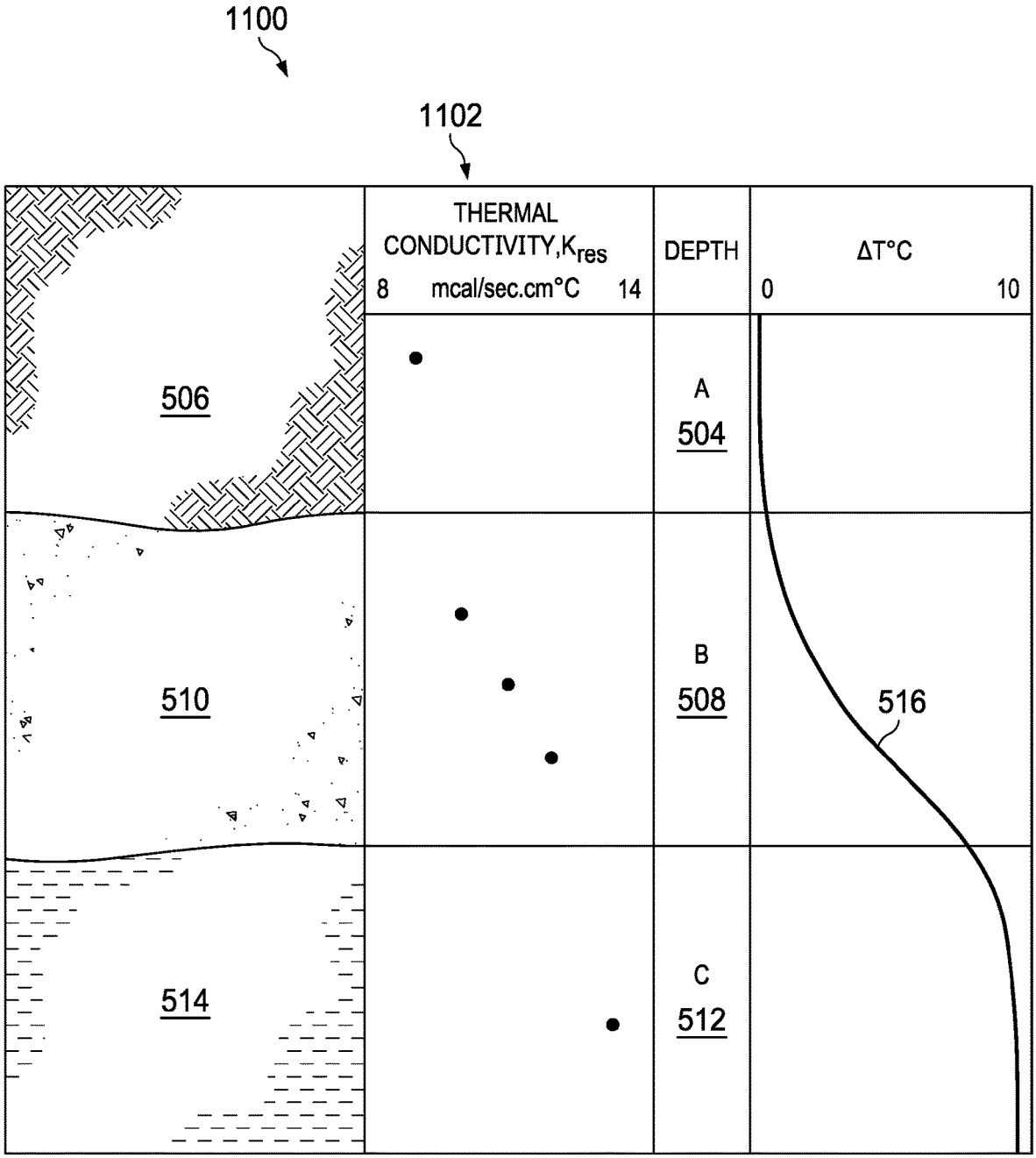
FIG. 11 is a graph of thermal conductivity in various zones of a formation.

FIG. 11 is a graph 1100 of thermal conductivity in various formations. The formations include the target formation 506, the second formation 510, and the third formation 514, each substantially similar to the various formations described earlier. The thermal conductivity 1102 increases from the target formation 506 to the second formation 510. The thermal conductivity then increased again from the second formation 510 to the third formation 514. The higher the water content of the formation, the higher the conductivity of the formation.

At 906, non-reservoir fluid effects of the mud flow rate and mud filtrate thermal conductivity (from 714) are removed from the differential temperature values. The non-reservoir fluid effects are removed using the pre-established correlations.

Figure 12:
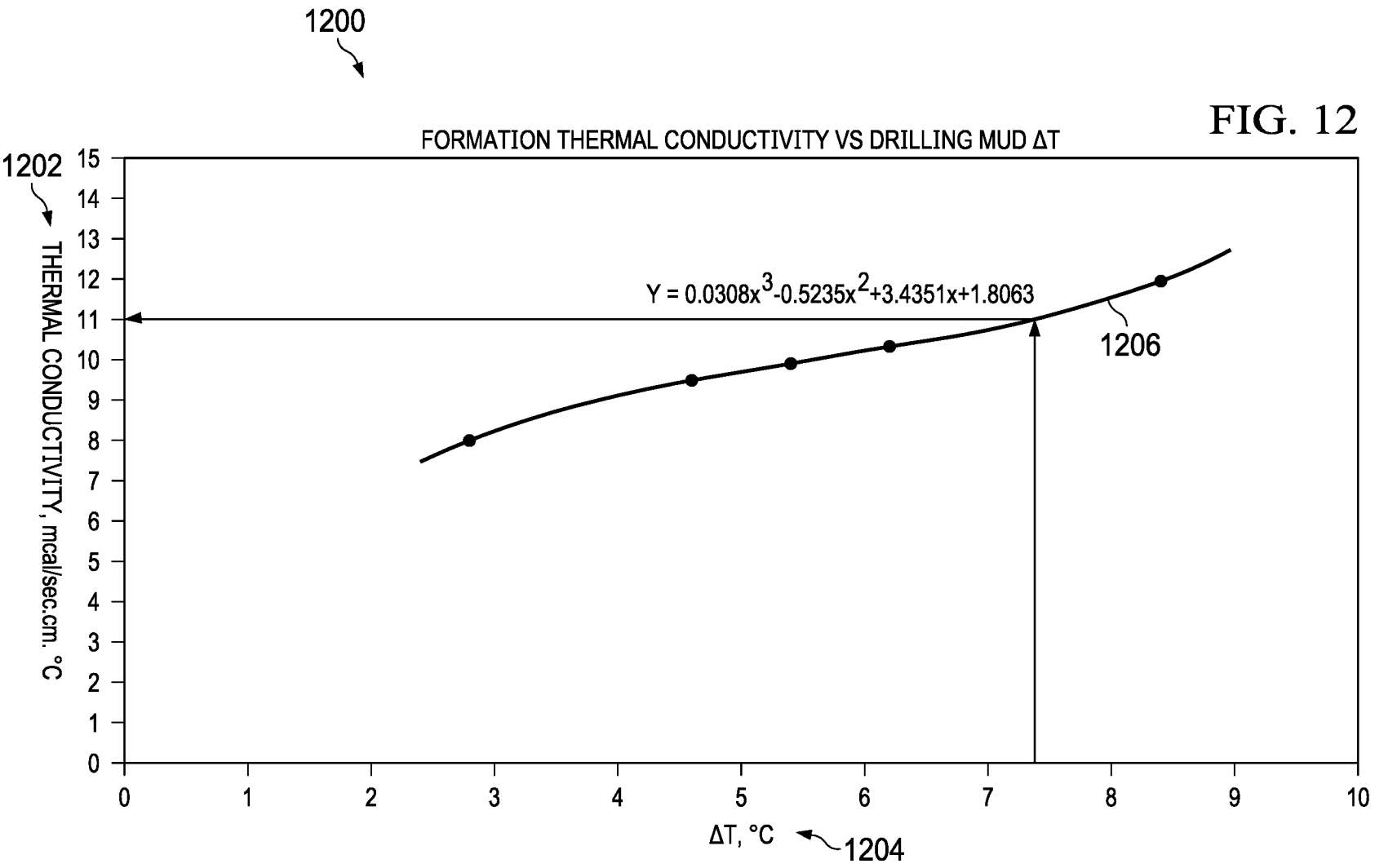
FIG. 12 is a graph of thermal conductivity of a formation versus the differential temperature of drilling mud.

At 908, a trend line equation is established between the differential temperature and the thermal conductivity points to calculate a thermal conductivity at any differential temperature. FIG. 12 is a graph 1200 of thermal conductivity 1202 of an example formation versus the differential temperature 1204 of drilling mud 170. The trend line 1206 illustrates the relationship between the thermal conductivity 1202 and the differential temperature 1204.

Figure 13:
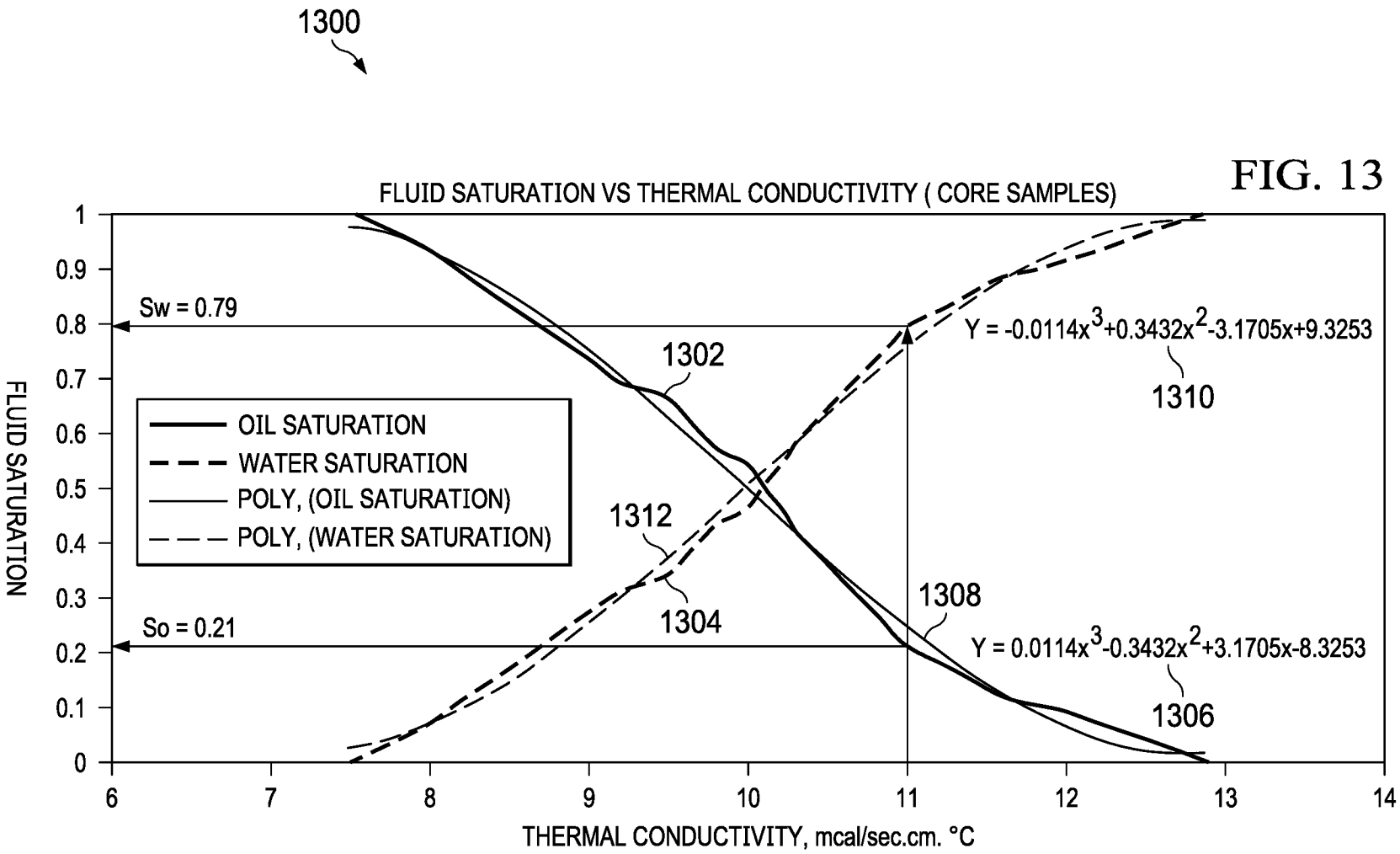
FIG. 13 is a graph of fluid saturation versus thermal conductivity in a core sample of a formation.

At 910, fluid saturation of the various formations of the vertical wellbore 502 are predicted from thermal conductivity of core samples and fluid saturations at the formation pressure and temperature. FIG. 13 is a graph of fluid saturation versus thermal conductivity in a core sample of a formation. An oil saturation trend line 1302 shows the trend of fluid saturation versus thermal conductivity. A water saturation trend line 1304 shows the trend of fluid saturation versus thermal conductivity. The oil saturation curve trend line equations are generated to predict the fluid saturation of the various formation zones of the vertical wellbore 502. For example, oil saturation equation 1306 is generated from the oil saturation trend line 1302. The oil saturation polynomial 1308 is graphed form the oil saturation equation 1306. For example, water saturation equation 1310 is generated from the water saturation trend line 1304. The water saturation polynomial 1312 is graphed form the water saturation equation 1310.

Figure 10A:
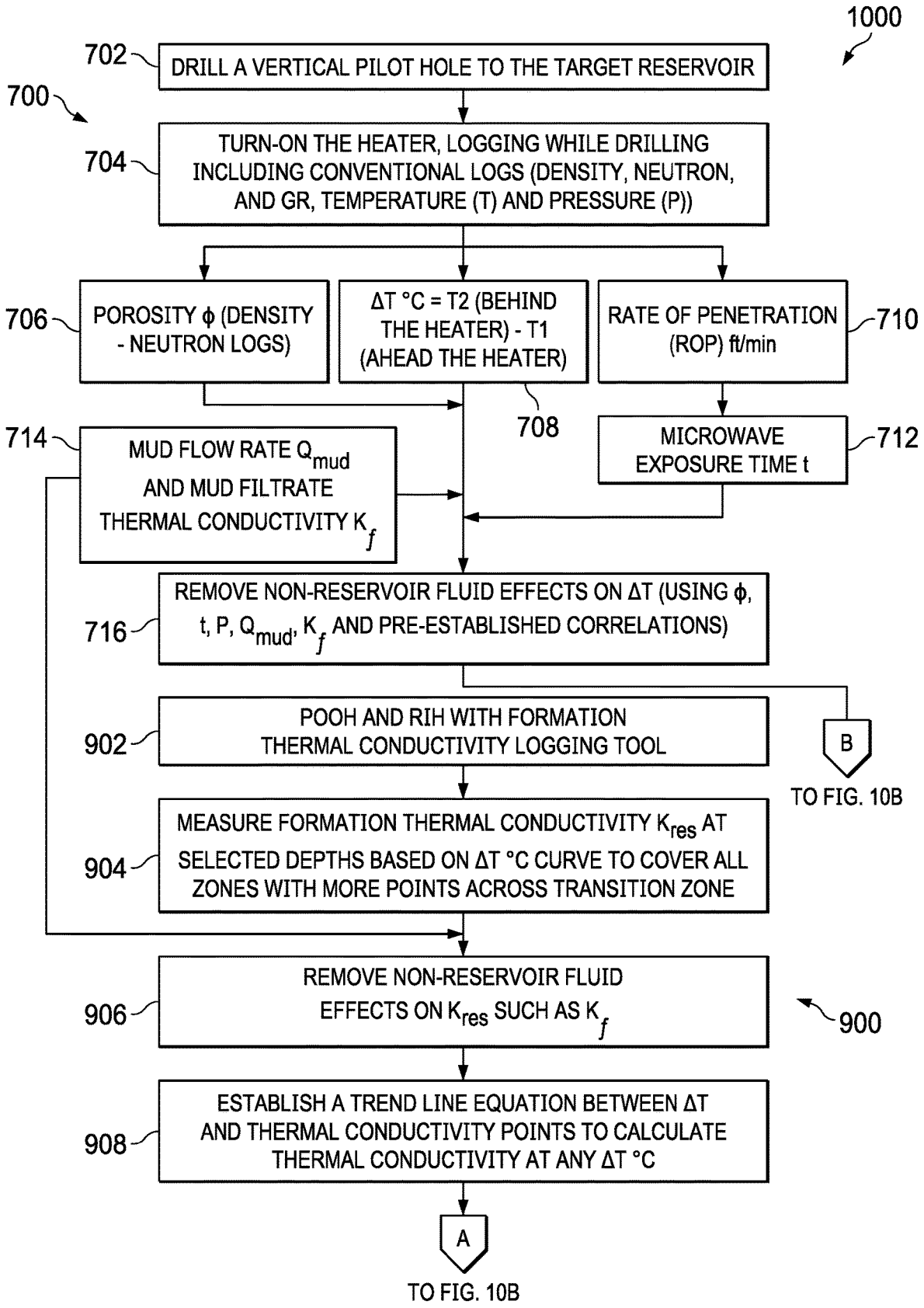
FIGS. 10A and 10B are a flow chart of an example method of drilling a horizontal wellbore using quantitative measurements with the drilling assembly of FIG. 6.
Figure 10B:
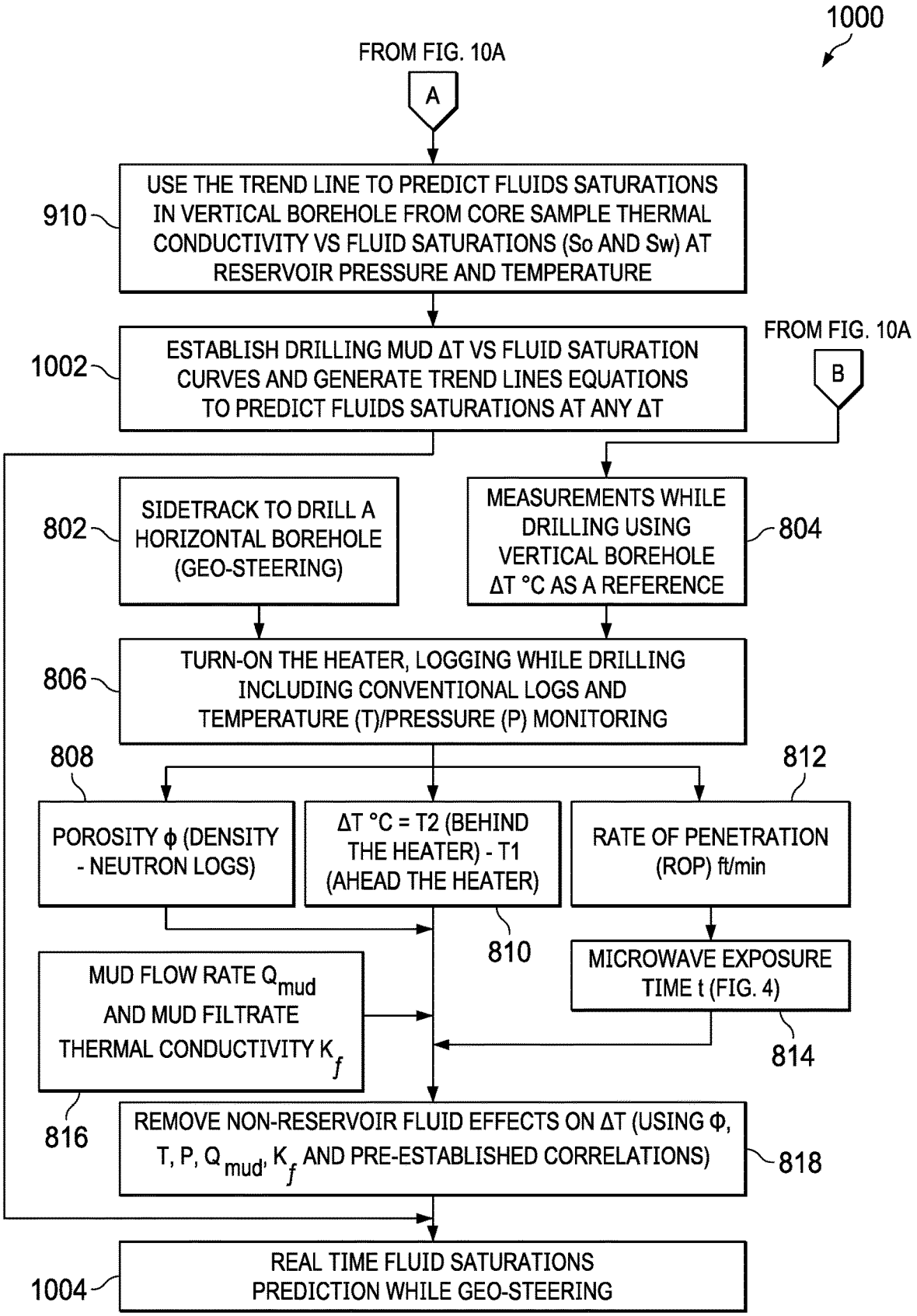
Figure 14:
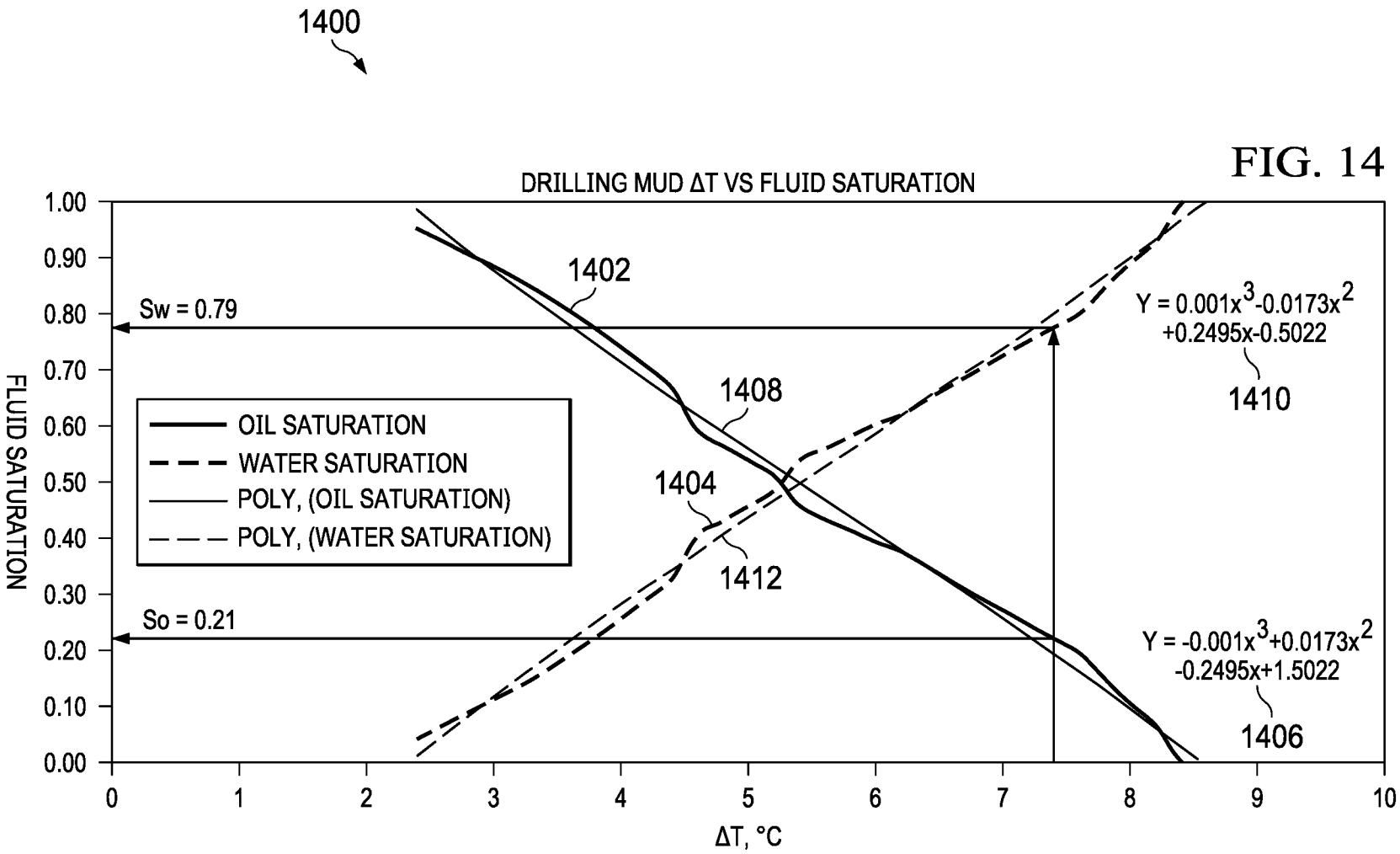
FIG. 14 is a graph of drilling mud differential temperature versus fluid saturation.

FIGS. 10A and 10B are a flow chart of an example method 1000 of drilling a horizontal wellbore 602 using quantitative measurements with the drilling assembly 100 of FIG. 6. Method 1000 includes the methods 700-900 previously described. FIG. 14 is a graph 1400 of drilling mud 170 differential temperature versus fluid saturation. The quantitative measurements and methods described in reference to FIGS. 9-14 regarding fluid saturation quantification are additional methods for evaluation of the subterranean Earth 104. Referring to FIGS. 6, 7, and 9— 14, at 1002, drilling mud 170 differential temperature versus fluid saturation curves are established. The steps 902-910 of method 900 and from 716 of method 700 input to 1002. For example, the oil saturation trend line 1402 and the water saturation trend line 1404 are established. Trend line equations are generated to predict fluid saturations at any differential temperature. For example, oil saturation equation 1406 is generated from the oil saturation trend line 1402. The oil saturation polynomial 1408 is graphed form the oil saturation equation 1406. For example, water saturation equation 1410 is generated from the water saturation trend line 1404. The water saturation polynomial 1412 is graphed form the water saturation equation 1410.

At 1004, the differential temperature versus fluid saturation from 1002 are compared to the differential temperatures from method 800, steps 802-818 to predict real time fluid saturations while steering the drilling assembly 100.

In some implementations, the technologies and methods described here, especially in reference to the qualitative procedures described in reference to FIGS. 9-10B, can include stopping drilling and conducting station measurements of formation temperature as a function of time with the heater assembly 112 of the drilling assembly 100. The temperature transient analysis are performed by analyzing temperature and temperature-time derivatives for reservoir characterization. The temperature transient analyses are performed as described in U.S. patent application Ser. No. 16/863,740, the entire contents of which are incorporated herein by reference.

Figure 15:
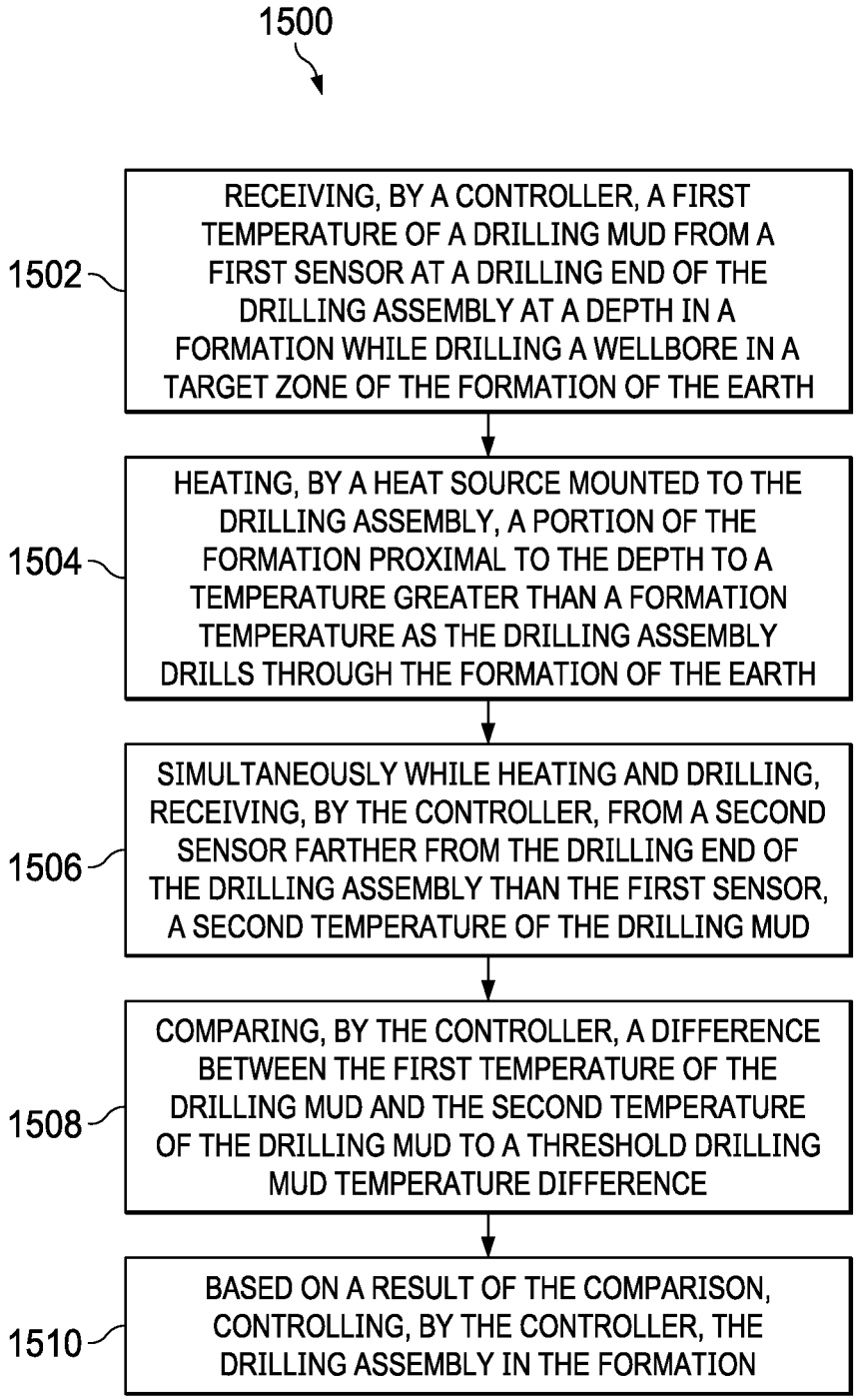
FIG. 15 is a flow chart of an example method of heating and evaluating while drilling a wellbore according to the implementations of the present disclosure.

FIG. 15 is a flow chart of an example method 1500 of heating and evaluating a formation of the Earth while drilling a wellbore in the formation according to the implementations of the present disclosure. At 1502, while drilling a wellbore in a target zone of a formation of the Earth with a drilling assembly, a first signal representing a first drilling mud temperature at a drilling end of the drilling assembly is received by a controller and from a first sensor. The first drilling mud temperature is at a depth in the wellbore. Receiving the first signal representing the first drilling mud temperature at the depth in the wellbore by the controller and from the first sensor can include the first sensor sensing the first drilling mud temperature at the depth in the wellbore.

At 1504, after receiving the first signal, a heat source mounted to the drilling assembly heats a portion of the formation proximal to the depth to a temperature greater than a formation temperature as the drilling assembly drills through the formation of the Earth. The heat source can be multiple magnetrons. When the heat source is multiple magnetrons, heating the formation includes energizing the magnetrons. After the magnetrons are energized, the magnetrons generate heat in the formation.

In some cases, heating the formation with magnetrons includes transmitting microwaves from each of the magnetrons in an axis parallel to a longitudinal axis of the drilling assembly. In some cases, the magnetrons are positioned in between multiple bars mounted to an external surface of the drilling assembly. When the magnetrons are positioned in between multiple bars mounted to an external surface of the drilling assembly, transmitting microwaves from each of the magnetrons in an axis parallel to a longitudinal axis of the drilling assembly includes engaging the bars to an inner surface of the wellbore.

In some cases, the drilling assembly includes a sleeve. The sleeve is mechanically coupled to a downhole conveyor by a bearing assembly. The sleeve is rotatably isolated from a rotation of the drilling assembly. The magnetrons are positioned on the sleeve of the drilling assembly. Transmitting microwaves from each of the magnetrons in an axis parallel to a longitudinal axis of the drilling assembly includes rotating the drilling assembly and maintaining, by the bearing assembly, the axis of the magnetrons parallel to the longitudinal axis of the drilling assembly.

In some cases, the sleeve is electrically coupled to a power source by an electrical slip ring. When the sleeve is electrically coupled to a power source by the electrical slip ring, transmitting microwaves from each of the magnetrons in an axis parallel to the longitudinal axis of the drilling assembly includes flowing electricity from the power source, receiving electricity at the electrical slip ring, transferring electricity through the electrical slip ring, and flowing electricity to the magnetrons.

At 1506, simultaneously while heating the portion of the formation proximal to the depth while the drilling assembly drills through the formation of the Earth, a second signal representing a second drilling mud temperature is received by the controller from a second sensor. The second sensor is farther from the drilling end of the drilling assembly than the first sensor. The heat source is positioned in the drilling assembly between the first sensor and the second sensor. In some cases, receiving, by the controller and from the second sensor, the second signal representing the second drilling mud temperature in the wellbore includes the second sensor sensing the second drilling mud temperature in the wellbore.

At 1508, the controller compares a difference between the value of the first temperature and the value of the second temperature to a threshold temperature difference value. Comparing, by the controller, the difference between the value of the first temperature and the value of the second temperature to the threshold temperature difference value can include determining when the difference between the value of the first temperature and the value of the second temperature is less than the threshold temperature difference value, indicating that the drilling assembly is in a oil-bearing portion of the formation and the target zone is the oil-bearing portion of the formation. Comparing, by the controller, the difference between the value of the first temperature and the value of the second temperature to the threshold temperature difference value can include determining when the difference between the value of the first temperature and the value of the second temperature is greater than the threshold difference value, indicating that the drilling assembly is in a water-bearing portion of the formation and the target zone is the oil-bearing portion of the formation.

Figure 16:
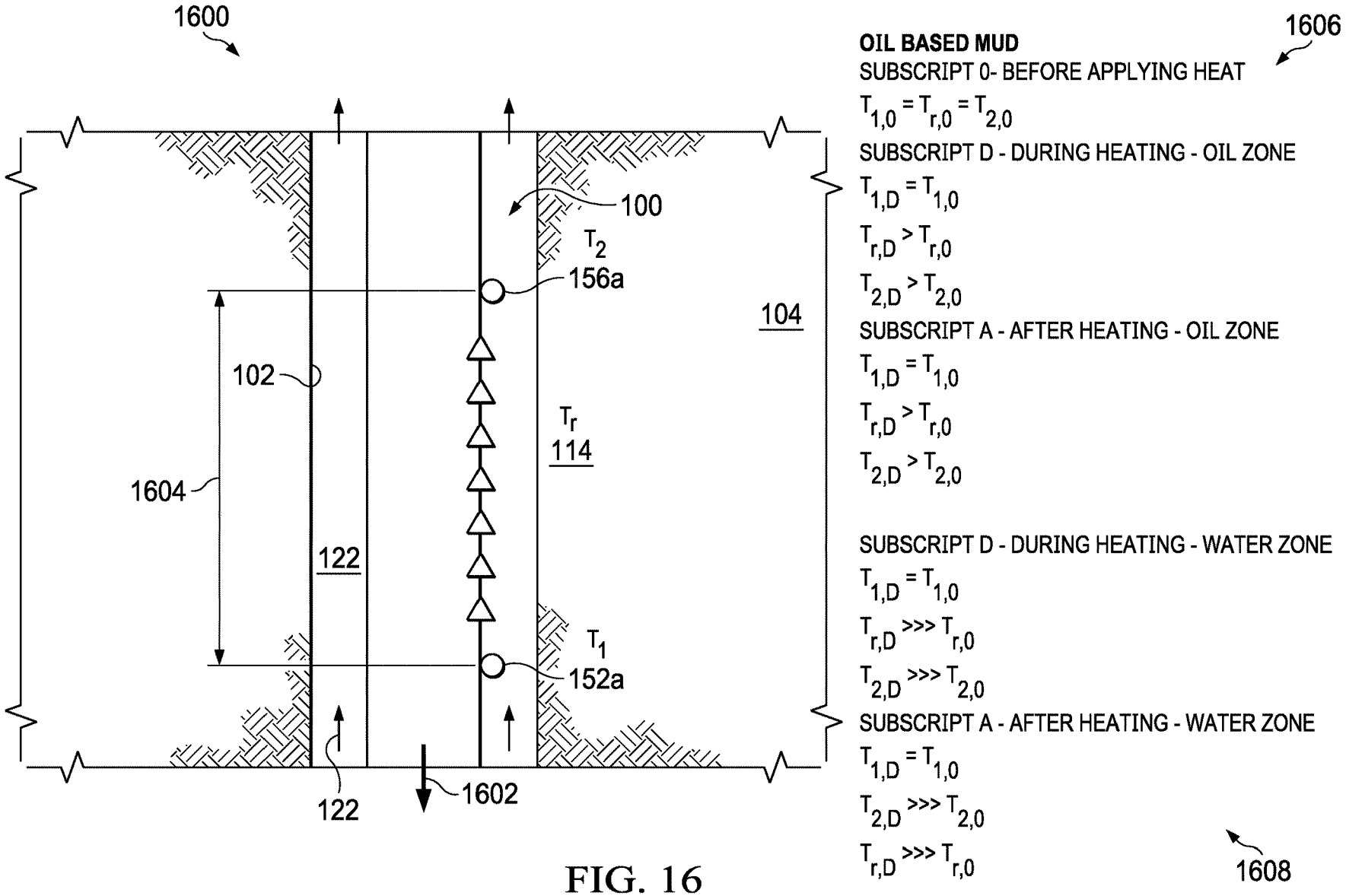
FIG. 16 is another schematic of the drilling assembly including the heating assembly disposed in the wellbore of FIG. 1A.

FIG. 16 is another schematic of the drilling assembly 100 including the heating assembly 112 disposed in the wellbore 102 of FIG. 1A. Referring to FIG. 16, the drilling assembly 100 is drilling in the wellbore 102 in the direction of arrow 1602. A length 1604 separates the first sensor 152*a* from the second sensor 156*a*. $T_1$ is the sensed temperature at the first sensor 152*a*. $T_2$ is the sensed temperature at the second sensor 156*a*. $T_r$ is the temperature of the subterranean Earth 104, that is, the reservoir that the drilling assembly 100 is drilling the wellbore 102 through. To is the temperature of the subterranean Earth 104 before the drilling assembly 100 heats the portion 114 of the subterranean Earth 104. Subscript map 1606 shows relative changes in relationships between the various temperatures before, during, and after heating when the drilling assembly is in an oil based mud in the oil-bearing portion of the formation (an oil zone). Subscript map 1608 shows the relative changes in relationships between the various temperatures before, during, and after heating when the drilling assembly is in oil based mud in the water-bearing portion of the formation (a water zone).

At 1510, based on a result of the comparison, the controller controls the drilling assembly in the formation. Controlling, by the controller, the drilling assembly in the formation can include, responsive to determining when the difference between the value of the first temperature and the value of the second temperature is less than the threshold difference value, maintaining the drilling assembly in the target zone. Controlling, by the controller, the drilling assembly in the formation can include, responsive to determining when the difference between the value of the first temperature and the value of the second temperature is greater than the threshold difference value, steering the drilling assembly from the water-bearing portion of the formation to the target oil-bearing portion of the formation. Steering or maintaining the drilling assembly can include adjusting at least one of a weight on bit, a revolution per minute, a tool face orientation, a drilling direction, a drilling azimuth, or a fluid flow rate of the drilling mud.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

What is claimed is:

1. A method comprising:

while drilling a wellbore in a target zone of a formation of the Earth with a drilling assembly, the wellbore comprising a drilling mud:

receiving, by a controller and from a first sensor, a first signal representing a first temperature of the drilling mud at a drilling end of the drilling assembly, the first temperature of the drilling mud at a depth in the wellbore;

after receiving the first signal, heating, by a heat source mounted to the drilling assembly, a portion of the formation proximal to the depth, to a temperature greater than a formation temperature as the drilling assembly drills through the formation of the Earth;

simultaneously while heating the portion of the formation proximal to the depth while the drilling assembly drills through the formation of the Earth and the drilling mud receiving heat back from the portion of the formation by a flow of the drilling mud, receiving, by the controller from a second sensor, the second sensor farther from the drilling end of the drilling assembly than the first sensor, a second signal representing a second temperature of the drilling mud, the heat source positioned in the drilling assembly between the first sensor and the second sensor;

comparing, by the controller, a difference between of the first temperature of the drilling mud and the second temperature of the drilling mud to a threshold drilling mud temperature difference;

based on a result of the comparison, determining when the difference between the first temperature of the drilling mud and the second temperature of the drilling mud is less than the threshold drilling mud temperature difference, indicating that the drilling assembly is in an oil-bearing portion of the formation and the target zone is the oil-bearing portion of the formation; and based on determining when the difference between the first temperature of the drilling mud and the second temperature of the drilling mud is less than the threshold drilling mud temperature difference, controlling, by the controller, the drilling assembly in the formation, wherein controlling the drilling assembly in the formation comprises maintaining the drilling assembly in the target zone.

2. The method of claim 1, wherein receiving, by the controller and from the first sensor, the first signal representing the first temperature of the drilling mud at the depth comprises sensing, by the first sensor, the first temperature of a portion of the drilling mud in the wellbore proximal to the formation at the depth in the wellbore, and receiving, by the controller and from the second sensor, the second signal representing the second temperature of the drilling mud comprises sensing, by the second sensor, the second temperature of the portion of the drilling mud in the wellbore proximal to the formation.

3. The method of claim 1, further comprising:

based on the result of the comparison, determining when the difference between the first temperature of the drilling mud and the second temperature of the drilling mud is greater than the threshold drilling mud temperature difference , indicating that the drilling assembly is in a water-bearing portion of the formation and the target zone is the oil-bearing portion of the formation; and based on determining when the difference between the value of the first temperature of the drilling mud and the second temperature of the drilling mud is greater than the threshold drilling mud temperature difference , controlling, by the controller, the drilling assembly in the formation, wherein controlling the drilling assembly in the formation comprises steering the drilling assembly from the water-bearing portion of the formation to oil-bearing portion of the formation.

4. The method of claim 3, wherein steering the drilling assembly comprises adjusting at least one of a weight on bit, a revolution per minute, a tool face orientation, a drilling direction, a drilling azimuth, or a drilling mud flow rate.

5. The method of claim 1, wherein the heat source is a plurality of magnetrons, and wherein heating the formation comprises:

energizing the plurality of magnetrons; and transmitting a plurality of microwaves from each of the plurality of magnetrons to the formation.

6. The method of claim 5, wherein heating the formation further comprises transmitting the plurality of microwaves from each of the plurality of magnetrons in an axis parallel to a longitudinal axis of the drilling assembly.

7. The method of claim 5, wherein the drilling assembly comprises a sleeve, the sleeve mechanically coupled to a downhole conveyor by a bearing assembly, the sleeve rotatably isolated from a rotation of the drilling assembly, the plurality of magnetrons positioned on the sleeve, transmitting the plurality of microwaves from each of the plurality of magnetrons in an axis parallel to a longitudinal axis of the drilling assembly comprises:

rotating the drilling assembly; and maintaining, by the bearing assembly, the axis of the plurality of magnetrons parallel to the longitudinal axis of the drilling assembly.

8. The method of claim 7, wherein the sleeve is electrically coupled to a power source by an electrical slip ring, transmitting the plurality of microwaves from each of the plurality of magnetrons in the axis parallel to the longitudinal axis of the drilling assembly comprises:

flowing electricity from the power source;

receiving electricity at the electrical slip ring;

transferring electricity through the electrical slip ring; and flowing electricity to the plurality of magnetrons.

9. An assembly comprising:

a sleeve configured to couple to a drilling assembly and disposed in a wellbore comprising a drilling mud;

a heat source positioned in the sleeve, the heat source configured to heat a portion of a formation of the Earth;

a first sensor positioned at a first end of the sleeve, the first sensor configured to sense a first condition of the drilling mud at a depth and transmit a signal representing a value of the first condition of the drilling mud at the depth before the heat source heats the portion of the formation of the Earth, wherein the first sensor is a first temperature sensor and the first condition is a first temperature of the drilling mud;

a second sensor positioned at a second end of the sleeve, the second sensor configured to sense a second condition of the drilling mud responsive to the drilling mud receiving heat back from the portion of the formation by a flow of the drilling mud after the heat source heats the portion of the formation and transmit a signal representing a value of the second condition of the drilling mud, wherein the second sensor is a second temperature sensor and the second condition is a second temperature of the drilling mud; and a controller configured to:

receive the signal representing the value of the first condition;

receive the signal representing the value of the second condition;

compare a difference between the value of the first condition and the value of the second condition to a threshold difference value, wherein the threshold difference value is a threshold drilling mud temperature difference value; and based on a result of the comparison, generate a command signal to control the drilling assembly, wherein in response to the difference between the value of the first temperature of the drilling mud and the value of the second temperature of the drilling mud less than the threshold drilling mud temperature difference value, indicating the drilling assembly is in an oil-bearing portion of the formation and a target zone is the oil-bearing portion of the formation, the command signal to control the drilling assembly maintains the drilling assembly in the target zone.

10. The assembly of claim 9, further comprising:

a first connection mechanically coupled to the sleeve, the first connection configured to mechanically couple to a downhole conveyor; and a second connection mechanically coupled to the sleeve, the second connection configured to mechanically couple to a downhole tool.

11. The assembly of claim 9, further comprising a bearing assembly positioned within the sleeve, the bearing assembly configured to rotatably isolate the sleeve from a rotation of a downhole conveyor.

12. The assembly of claim 9, further comprising a plurality of bars mechanically coupled to an outside surface of the sleeve, the plurality of bars configured to slideably engage an inner surface of the wellbore.

13. The assembly of claim 9, further comprising an electrical slip ring positioned within the sleeve, the electrical slip ring configured to transfer electricity from a power source to the heat source.

14. The assembly of claim 9, wherein the heat source comprises a plurality of magnetrons.

15. The assembly of claim 14, wherein a portion of the plurality of magnetrons are arranged linearly relative to a longitudinal axis of the sleeve.

16. The assembly of claim 9, wherein the controller is further configured to:

responsive to the comparison, determine when the difference between the value of the first temperature of the drilling mud and the value of the second temperature of the drilling mud is greater than the threshold drilling mud temperature difference value, indicating the drilling assembly is in a water-bearing portion of the formation and the target zone is the oil-bearing portion of the formation; and responsive to determining when the difference between the value of the first temperature of the drilling mud and the value of the second temperature of the drilling mud is greater than the threshold drilling mud temperature difference value, steer the drilling assembly from the water-bearing portion of the formation to the oil-bearing portion of the formation.

* * * * *